US006980186B2

(12) United States Patent
Nakano et al.

(10) Patent No.: US 6,980,186 B2
(45) Date of Patent: Dec. 27, 2005

(54) LIQUID CRYSTAL DISPLAY HAVING A STAGGERED STRUCTURE PIXEL ARRAY

(75) Inventors: Taketoshi Nakano, Kawasaki (JP); Asahi Yamato, Yokohama (JP); Takafumi Kawaguchi, Taki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 271 days.

(21) Appl. No.: 10/317,922

(22) Filed: Dec. 12, 2002

(65) Prior Publication Data

US 2003/0107543 A1 Jun. 12, 2003

(30) Foreign Application Priority Data

Dec. 12, 2001 (JP) ..... P2001-378031

(51) Int. Cl.[7] ..... G09G 3/28

(52) U.S. Cl. ..... 345/88; 345/94; 345/96; 345/208; 345/213

(58) Field of Search ..... 345/87–100, 204–213

(56) References Cited

U.S. PATENT DOCUMENTS 5,982,347 A * 11/1999 Shigeta et al. ..... 345/88
6,310,592 B1 * 10/2001 Moon et al. ..... 345/87
6,593,905 B1 * 7/2003 Lay ..... 345/92

FOREIGN PATENT DOCUMENTS

| | | |
|---|---|---|
| JP | 04-309926 | 11/1992 |
| JP | 05-134629 | 5/1993 |
| JP | 06-035417 | 2/1994 |
| JP | 06-035418 | 2/1994 |

OTHER PUBLICATIONS

Electronic translation of Japanese patent Publication No. 06–035417.*

* cited by examiner

*Primary Examiner*—Amr A. Awad
(74) *Attorney, Agent, or Firm*—Edwards & Angell, LLP; David G. Conlin; George W. Hartnell, III

(57) ABSTRACT

A liquid crystal panel having pixel-forming portions that are assigned dispersedly to two mutually adjacent rows of pixels sandwiching the scanning signal line Lg from above and below, in a horizontally periodical pattern having a cycle of "up down, up" or "down, up, down" as to which of the up row and the down row is selected in the assignment of three pixel electrodes. This staggered structure provides a quasi dot inversion driving method while reducing vertical shadow when displaying e.g. the "checker back".

10 Claims, 24 Drawing Sheets

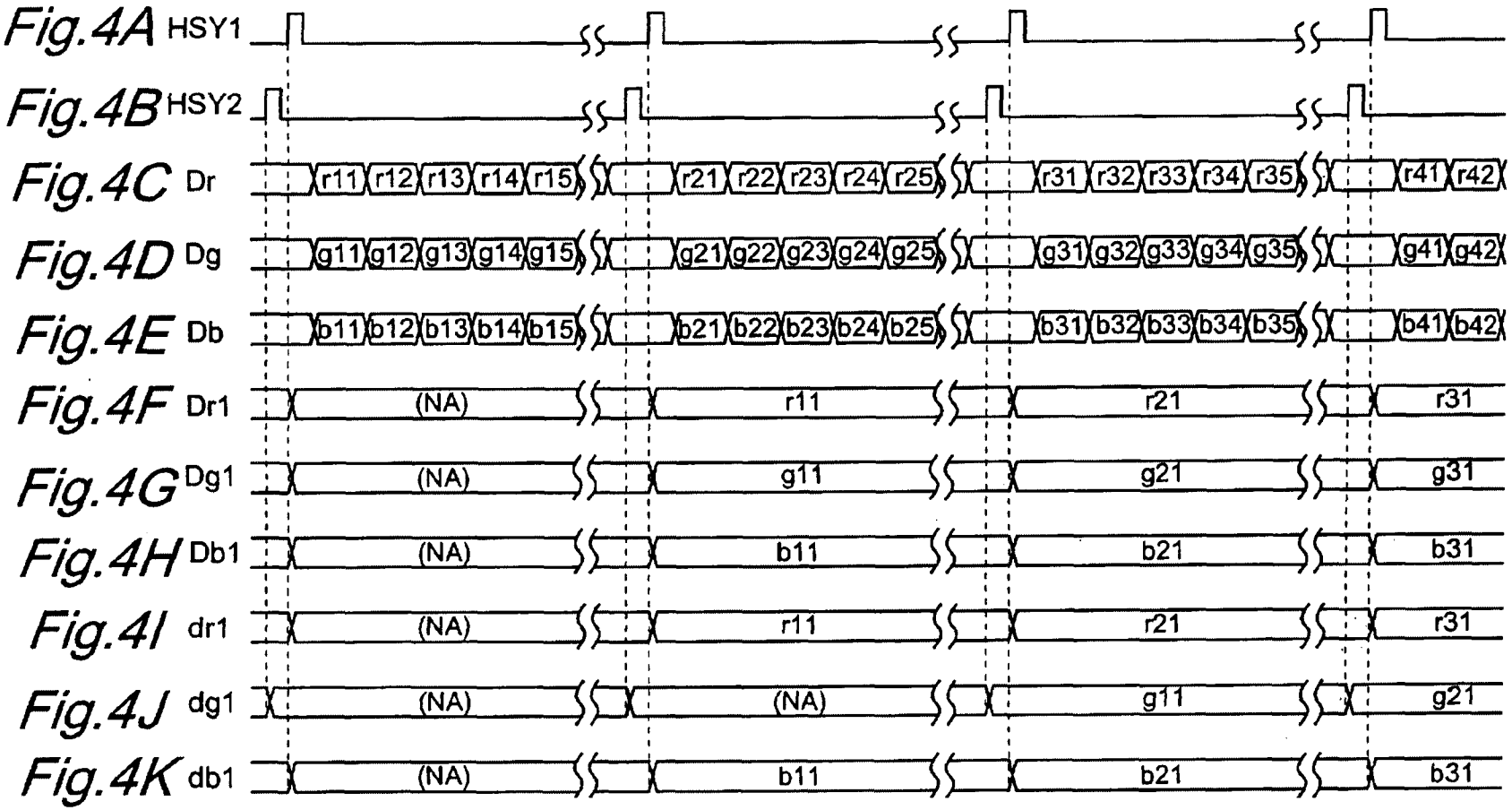
Fig.4A HSY1
Fig.4B HSY2
Fig.4C Dr
r11 r12 r13 r14 r15 r21 r22 r23 r24 r25 r31 r32 r33 r34 r35 r41 r42
Fig.4D Dg
g11 g12 g13 g14 g15 g21 g22 g23 g24 g25 g31 g32 g33 g34 g35 g41 g42
Fig.4E Db
b11 b12 b13 b14 b15 b21 b22 b23 b24 b25 b31 b32 b33 b34 b35 b41 b42
Fig.4F Dr1
(NA) r11 r21 r31
Fig.4G Dg1
(NA) g11 g21 g31
Fig.4H Db1
(NA) b11 b21 b31
Fig.4I dr1
(NA) r11 r21 r31
Fig.4J dg1
(NA) (NA) g11 g21
Fig.4K db1
(NA) b11 b21 b31

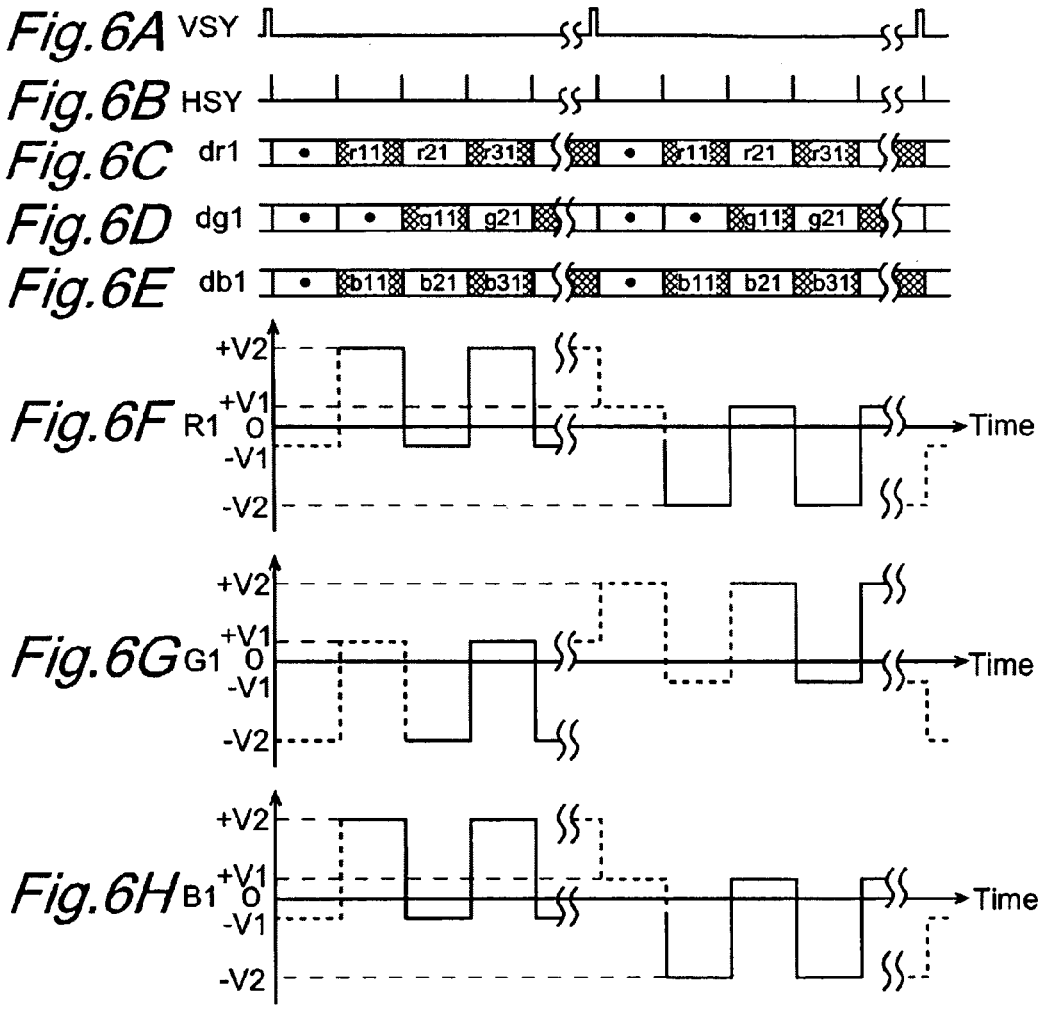
Fig.6A VSY
Fig.6B HSY
Fig.6C dr1
r11
r21
r31
Fig.6D dg1
g11
g21
Fig.6E db1
b11
b21
b31
Fig.6F R1
Fig.6G G1
Fig.6H B1
+V2
+V1
0
-V1
-V2
Time (F1→F2)

*Fig. 8A* Amounts of data signal change regarding pixels in column G1
- Displayed image: Checker back
- Baseline: signal value when data was written into pixel

| Pixel | Column G1, Row 1(-V2) | | | | | | Column G1, Row 5(-V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (G1) | 0 | +(V1+V2) | 0 | +(V1+V2) | 0 | +(V1+V2) | +2V2 | +(V2-V1) | +2V2 | +(V2-V1) |
| Adjacent data line (B1) | 0 | +(V1+V2) | 0 | +(V1+V2) | 0 | +(V1+V2) | +2V1 | -(V2-V1) | +2V1 | -(V2-V1) |

*Fig. 8B* Amounts of data signal change regarding pixels in column B1
- Displayed image: Checker back
- Baseline: signal value when data was written into pixel

| Pixel | Column B1, Row 1(+V2) | | | | | | Column B1, Row 5(+V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (B1) | -(V1+V2) | 0 | -(V1+V2) | 0 | -(V1+V2) | 0 | -(V2-V1) | -2V2 | -(V2-V1) | -2V2 |
| Adjacent data line (R2) | -(V1+V2) | 0 | -(V1+V2) | 0 | -(V1+V2) | 0 | +(V2-V1) | -2V1 | +(V2-V1) | -2V1 |

(F1→F2)

*Fig. 10A* Amounts of data signal change regarding pixels in column G1
- Displayed image: Horizontal stripe back
- Baseline: signal value when data was written into pixel

| Pixel | Column G1, Row 1(-V2) | | | | | | Column G1, Row 5(-V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (G1) | 0 | +(V1+V2) | 0 | +(V1+V2) | 0 | +(V1+V2) | +2V2 | +(V2-V1) | +2V2 | +(V2-V1) |
| Adjacent data line (B1) | 0 | +(V1+V2) | 0 | +(V1+V2) | 0 | +(V1+V2) | +2V1 | -(V2-V1) | +2V1 | -(V2-V1) |

*Fig. 10B* Amounts of data signal change regarding pixels in column B1
- Displayed image: Horizontal stripe back
- Baseline: signal value when data was written into pixel

| Pixel | Column B1, Row 1(+V2) | | | | | | Column B1, Row 5(+V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (B1) | -(V1+V2) | 0 | -(V1+V2) | 0 | -(V1+V2) | 0 | -(V2-V1) | -2V2 | -(V2-V1) | -2V2 |
| Adjacent data line (R2) | -(V1+V2) | 0 | -(V1+V2) | 0 | -(V1+V2) | 0 | -(V2-V1) | -2V2 | -(V2-V1) | -2V2 |

*Fig. 12A* Amounts of data signal change regarding pixels in column G1
- Displayed image: Horizontal stripe back
- Baseline: signal value when data was written into pixel

| Pixel | Column G1, Row 1(-V2) | | | | | | Column G1, Row 5(-V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (G1) | 0 | +(V1+V2) | 0 | +(V1+V2) | 0 | +(V1+V2) | +2V2 | +(V2-V1) | +2V2 | +(V2-V1) |
| Adjacent data line (B1) | 0 | +(V1+V2) | 0 | +(V1+V2) | 0 | +(V1+V2) | +2V1 | -(V2-V1) | +2V1 | -(V2-V1) |

*Fig. 12B* Amounts of data signal change regarding pixels in column B1
- Displayed image: Horizontal stripe back
- Baseline: signal value when data was written into pixel

| Pixel | Column B1, Row 1(+V2) | | | | | | Column B1, Row 5(+V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (B1) | -(V1+V2) | 0 | -(V1+V2) | 0 | -(V1+V2) | 0 | -(V2-V1) | -2V2 | -(V2-V1) | -2V2 |
| Adjacent data line (R2) | -(V1+V2) | 0 | -(V1+V2) | 0 | -(V1+V2) | 0 | +(V2-V1) | -2V1 | +(V2-V1) | -2V1 |

Modified staggered-structure
(3-column cycle)
Displayed image:
Checker back

Modified staggered-structure
(3-column cycle)
Displayed image:
Horizontal stripe back Common staggered-structure
Displayed image:
Checker back Common staggered-structure
Displayed image:
Horizontal stripe back Modified staggered-structure
(12-column cycle)
Displayed image:
Checker back Modified staggered-structure
(12-column cycle)
Displayed image:
Horizontal stripe back Fig.20A PRIOR ART
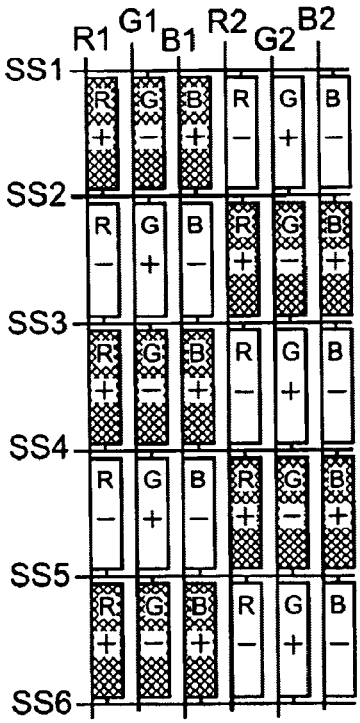
Fig.20B PRIOR ART
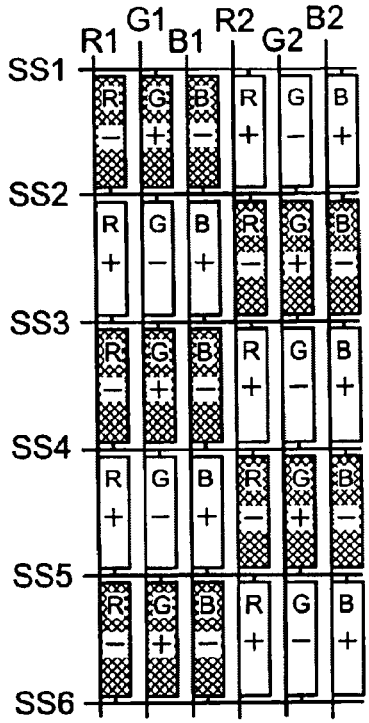
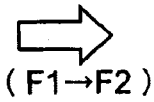
Fig.20C
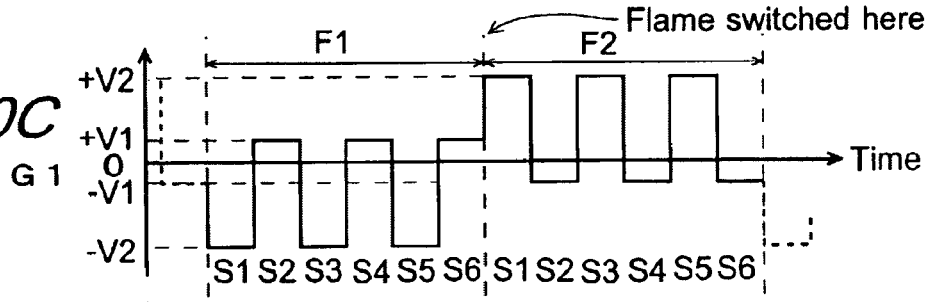
Fig.20D
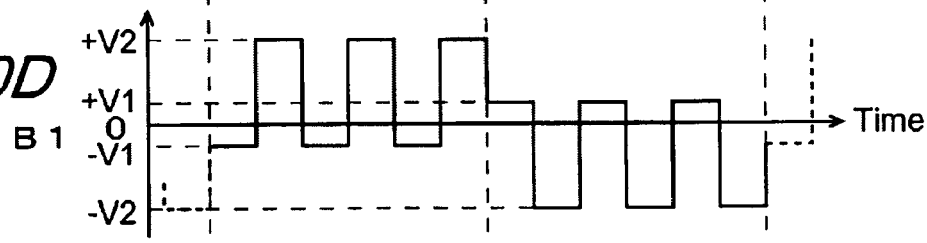
Fig.20E
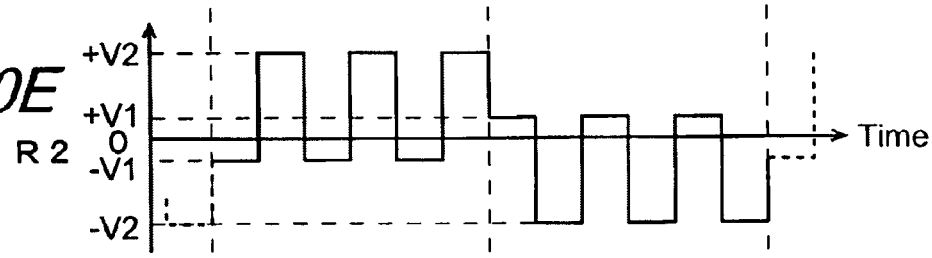

*Fig. 21A*

Amounts of data signal change regarding pixels in column G1
- Displayed image: Checker back in quasi dot inversion method
- Baseline: signal value when data was written into pixel

| Pixel | Column G1, Row 1(-V2) | | | | | | Column G1, Row 5(-V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (G1) | 0 | +(V1+V2) | 0 | +(V1+V2) | 0 | +(V1+V2) | +2V2 | +(V2-V1) | +2V2 | +(V2-V1) |
| Adjacent data line (B1) | 0 | +(V1+V2) | 0 | +(V1+V2) | 0 | +(V1+V2) | +2V1 | -(V2-V1) | +2V1 | -(V2-V1) |

*Fig. 21B*

Amounts of data signal change regarding pixels in column B1
- Displayed image: Checker back in quasi dot inversion method
- Baseline: signal value when data was written into pixel

| Pixel | Column B1, Row 1(+V2) | | | | | | Column B1, Row 5(+V2) | | | |
|---|---|---|---|---|---|---|---|---|---|---|
| Period | F1 | | | | | | F2 | | | |
| | S1 | S2 | S3 | S4 | S5 | S6 | S1 | S2 | S3 | S4 |
| Feeding data line (B1) | -(V1+V2) | 0 | -(V1+V2) | 0 | -(V1+V2) | 0 | -(V2-V1) | -2V2 | -(V2-V1) | -2V2 |
| Adjacent data line (R2) | -(V1+V2) | 0 | -(V1+V2) | 0 | -(V1+V2) | 0 | -(V2-V1) | -2V2 | -(V2-V1) | -2V2 |

Fig.22A PRIOR ART
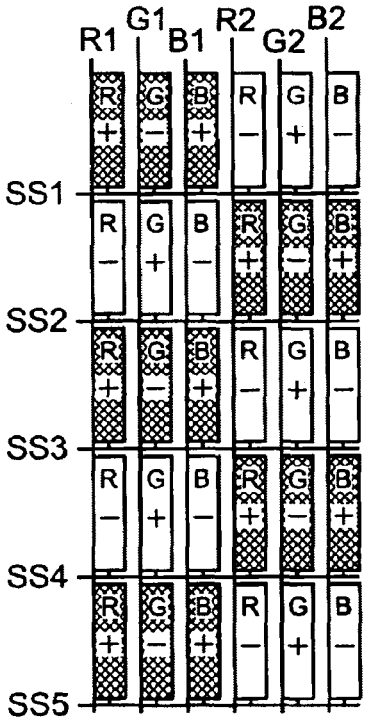
Fig.22B PRIOR ART
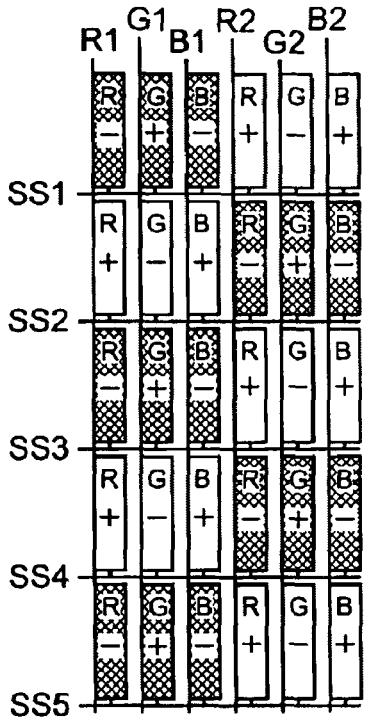
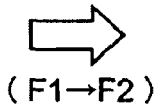
Fig.22C
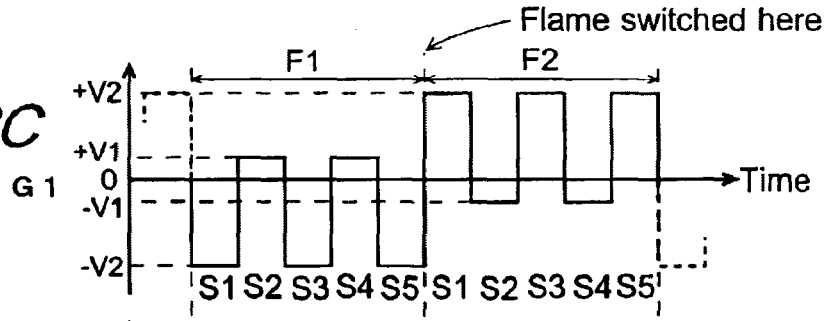
Fig.22D
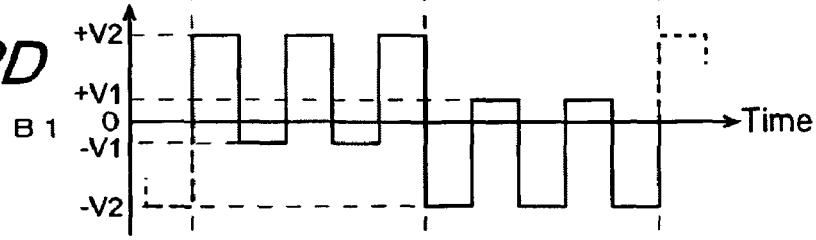
Fig.22E
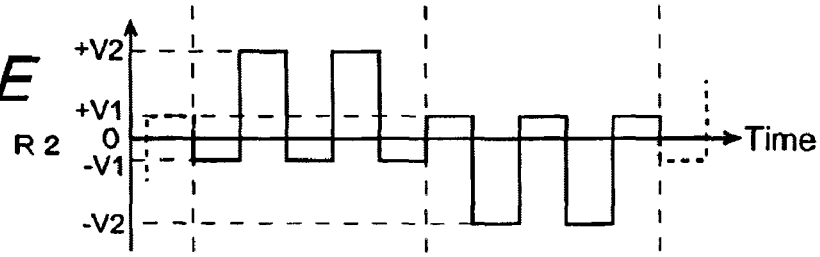

*Fig. 23A*

Amounts of data signal change regarding pixels in column G1
- Displayed image: Checker back in true dot inversion method
- Baseline: signal value when data was written into pixel

| Pixel | Column G1, Row 1(-V2) | | | | | Column G1, Row 5(-V2) | | | |
|---|---|---|---|---|---|---|---|---|---|
| Period | F1 | | | | | F2 | | | |
| | S1 | S2 | S3 | S4 | S5 | S1 | S2 | S3 | S4 |
| Feeding data line (G1) | 0 | +(V1+V2) | 0 | +(V1+V2) | 0 | +2V2 | +(V2-V1) | +2V2 | +(V2-V1) |
| Adjacent data line (B1) | 0 | -(V1+V2) | 0 | -(V1+V2) | 0 | -2V2 | -(V2-V1) | -2V2 | -(V2-V1) |

*Fig. 23B*

Amounts of data signal change regarding pixels in column B1
- Displayed image: Checker back in true dot inversion method
- Baseline: signal value when data was written into pixel

| Pixel | Column B1, Row 1(+V2) | | | | | Column B1, Row 5(+V2) | | | |
|---|---|---|---|---|---|---|---|---|---|
| Period | F1 | | | | | F2 | | | |
| | S1 | S2 | S3 | S4 | S5 | S1 | S2 | S3 | S4 |
| Feeding data line (B1) | 0 | -(V1+V2) | 0 | -(V1+V2) | 0 | -2V2 | -(V2-V1) | -2V2 | -(V2-V1) |
| Adjacent data line (R2) | 0 | +(V1+V2) | 0 | +(V1+V2) | 0 | +2V1 | -(V2-V1) | +2V1 | -(V2-V1) |

LIQUID CRYSTAL DISPLAY HAVING A STAGGERED STRUCTURE PIXEL ARRAY

BACKGROUND OF THE INVENTION

1. Field of the Invention

The present invention relates to an active-matrix liquid crystal display including a pixel array (so-called of "staggered structure") in which pixel electrodes belonging to the same scanning line are not assigned to the same straight line but staggered up and down in a zigzag pattern, thereby operating in a quasi dot inversion driving method.

2. Background Art

A conventional active-matrix liquid crystal panel includes two transparent substrates sandwiching a liquid crystal layer in between. One of the substrates has a surface formed with a plurality of data lines (may also be called "data signal line" or "column electrodes"), and a plurality of scanning signal lines (may also be called "row electrodes") intersecting the data lines. For each of the intersections, a pixel electrode is formed, to form a matrix of the pixel electrodes. Each pixel electrode is connected to the data line that passes the intersection relevant to the electrode, via a TFT (Thin Film Transistor) serving as a switching element. The TFT has its gate terminal connected to the scanning signal line that passes this intersection. The other transparent substrate is formed with a counter electrode that is common to the pixel electrodes. A liquid crystal display including a liquid crystal panel having a structure such as the above further includes a drive circuit for displaying images in the liquid crystal panel. The drive circuit includes a row electrode driving circuit (may also called "scanning line driving circuit" or "scan driver") that supplies the scanning signal lines with scanning signals for alternate and sequential selection of a line from the scanning signal lines, and a column electrode driving circuit (may also called "signal line driving circuit" or "data driver") that supplies the data lines with data signals for writing data onto each pixel-forming portion in the liquid crystal panel. With such a configuration, a voltage is applied between each pixel electrode and the counter electrode, at a value representing the value of the corresponding pixel. The applied voltage changes transmissivity of the liquid crystal layer, forming a desired image in the liquid crystal panel. In this operation, in order to protect liquid crystals in the liquid crystal layer from deterioration, the liquid crystal panel is driven by an alternating current. Specifically, the polarity of the voltage applied between each pixel electrode and the counter electrode is inverted for every frame for example, by the data signals outputted from the column electrode driving circuit.

Generally in active-type liquid crystal panels, the switching element such as the TFT provided for each of the pixels does not have perfect characteristics, and therefore, even if the column electrode driving circuit outputs symmetric data signals having a symmetric waveform in the positive and the negative phases (with respect to the baseline provided by an electric potential of the counter electrode), the liquid crystal layer does not respond in perfect symmetry in terms of transmissivity change to the positive and the negative data voltages. This causes flicker in the liquid crystal panel display if the display uses a driving method in which the positive and negative poles of the voltage applied to the liquid crystal are alternated for each frame (single-frame inversion driving method).

In an attempt to reduce such a flicker, there is disclosed a method in which the voltage polarity is inversed for each horizontal scanning line and for each frame (hereinafter called "1-H inversion driving method"). There is another method known in which the polarity of voltage applied to the liquid crystal layer or the pixels is inverted for each scanning signal line, each data line, and each frame (hereinafter called "dot inversion driving method). Now, in comparison, the dot inversion driving method is obviously superior to the 1-H inversion driving method in flicker reduction capability. Further, the 1-H inversion driving method has another disadvantage that when the user is following a moving image on the screen, he often perceives horizontal line marks.

As described, in view of display quality, the dot inversion driving method is advantageous over the 1-H inversion driving method. However, the 1-H inversion driving method offers an advantage that the column electrode driving circuit can be provided by an IC (integrated circuit) having a low withstand voltage since the voltage of the counter electrode (common electrode) is alternated for each horizontal scanning period. On the contrary, in the dot inversion driving method, when a positive voltage is applied to a pixel electrode in a given horizontal scanning line (a given line on the pixel matrix), a negative voltage is applied simultaneously to another pixel in the same line. For this reason, the IC for the column electrode driving circuit must have a high withstand voltage.

Under these circumstances, efforts are being made to achieve a seeming dot inversion driving method at a low withstand voltage, using the IC that is normally employed for the column electrode driving circuit operating in the 1-H inversion driving method. Thus, there is proposed a liquid crystal panel having a staggered structure as shown in FIG. 19A and FIG. 19B. Specifically, according to this liquid crystal panel which includes a matrix of pixel electrodes, the pixel electrodes sharing the same scanning signal line via TFTs are not assigned to a single line on the pixel matrix, but assigned in a dispersed manner to two mutually adjacent upper and lower lines, in an up-and-down zigzag pattern.

For example, the Japanese Patent Laid-Open No. 4-309926 discloses a liquid crystal display comprising a matrix array of display pixels each including a liquid crystal cell and a switching element. The display pixels in each of the columns and rows are connected by a grid of signal lines and scanning lines intersecting generally perpendicularly to each other. With this arrangement, the pixels driven by the above-described same scanning line are staggered up and down at least for every pixel of the signal line. The gazette further discloses a function of this liquid crystal display as follows: Pixels driven by the driving elements are staggered by one scanning line for every pixel of the signal line, and therefore, a normal flicker-less operation, in which the voltage polarity is altered for every scanning line, gives a perception as if inversion is made for every pixel, resulting in reduced perception of the vertical and the horizontal line marks.

However, such a seeming dot inversion driving as described above (hereinafter called quasi dot inversion driving), still leaves problems to be solved on the quality of display. Specifically, when a Windows (trademark) operating system displays a checker pattern as shown in FIG. 24A called "checker back" when closing the system for example, the pattern is accompanied by a stripe pattern extending vertically (hereinafter called "vertical shadow") in the above conventional liquid crystal display which utilizes the quasi dot inversion driving method. It should be noted that this vertical shadow also appears on the screen which is not driven in the quasi dot inversion driving method but in a genuine dot inversion driving method (hereinafter called "true dot inversion driving method"). For clarification of the problem, description will be made here below on why the vertical shadow appears in the quasi dot inversion driving method and the true dot inversion driving method.

As shown in FIG. 19C, each pixel-forming portion in the liquid crystal panel is sandwiched by two data lines Lss and Lsn, and includes: a TFT having its gate terminal connected to a scanning signal line Lg; a pixel electrode Ep connected to the data line Lss via the TFT; and a counter electrode Ec common to all of the pixel-forming portions. In this construction, one of the two data lines serves as a data line for writing data onto the pixel-forming portion (more specifically into a pixel capacity Cp formed by the pixel electrode Ep and the counter electrode Ec). This is the data line Lss (and hereinafter called "feeding data line"). Now, between the feeding data line Lss and the pixel electrode Ep of the pixel-forming portion, there is a parasitic capacity (hereinafter called "Csd (self)"). Similarly, between the other data line Lsn (hereinafter called "adjacent data line") and the pixel electrode Ep of the pixel-forming portion, there is another parasitic capacity (hereinafter called "Csd (other)"). For this reason, in each pixel after a data is written onto the pixel-forming portion of the pixel (i.e. when TFT is off), the value in this pixel is influenced by signal change in the data line Lss via Csd (self), and by signal change in the data line Lsn via Csd (other). Here below, description will be made on the basis that the signal changes in these feeding data line Lss and adjacent data line Lsn cause the vertical shadow. Note also that because Csd (self) is generally equal to Csd (other), the description will be made on the following premise: Csd (self)=Csd (other).

<Quasi Dot Inversion Driving Method>

First, a study will be made to a case in which the "checker back" is displayed in an active-matrix liquid crystal panel having a staggered structure such as shown in FIG. 19A–19C, and driven in the quasi dot inversion driving method. FIG. 19A schematically shows a construction of the liquid crystal panel. FIG. 19B shows an equivalent circuit for a portion 810 which includes 2×2 pixels on the liquid crystal panel shown in FIG. 19A. FIG. 19C shows an equivalent circuit for a portion including a single pixel in the liquid crystal panel, with the parasitic capacities illustrated in the drawing.

In this case, in one frame (period) F1, the "checker back" is displayed under a polarity pattern as shown in FIG. 20A, and in the next frame F2, the "checker back" is displayed under a polarity pattern as shown in FIG. 20B. For the sake of description, the example will use only five effective horizontal scanning lines and six data lines. (Note, however, that in the staggered structure, the number of scanning signal lines is six, or one more than the number of horizontal scanning lines effective for the display.) Note further, that in FIGS. 20A and 20B, crosshatched pixel-forming portions indicate that the display is made in black whereas pixel-forming portions without the crosshatch indicate that the display is made in white. The display is made by using a unit of display provided by mutually adjacent three pixels representing the colors of R (red), G (green) and B (blue). A block of white and a block of black are alternated with each other in the horizontal and the vertical directions. Reference symbols R1, G1, B1 and R2, G2, B2 each represents data signal fed to a corresponding one of the six data lines, and at the same time represents the corresponding column of the pixel-forming portion (hereinafter may also be called "pixel column" for convenience). (The premises given above for the study of the appearance mechanism of the vertical shadow will also apply in later discussions.)

In this case, the data signals G1, B1, R2 change as shown in FIGS. 20C, 20D and 20E respectively, with the baseline provided by an electric potential at the counter electrode Ec. In these FIGS. 20C–20E, "+V1" and "−V1" represent a positive voltage and a negative voltage respectively, to be applied to apart of the liquid crystal layer that forms the pixel-forming portion (hereinafter called "pixel liquid-crystal") for displaying the color of white. Likewise, "+V2" and "−V2" represent a positive voltage and a negative voltage respectively, to be applied to the pixel liquid-crystal for displaying the color of black. (This applies to all of the drawings hereinafter.) As already mentioned, "F1" and "F2" represent two sequential frames. "S1"–"S6" represent periods for which respective scanning signals SS1–SS6 shown in FIGS. 20A and 20B become active, i.e. the horizontal scanning periods in a frame.

Now, attention will be paid to a pixel-forming portion (hereinafter may also called "pixel" for simplicity) in the first row of Column G1. This pixel has a feeding data line Lss carrying a signal G1, and an adjacent data line Lsn carrying a signal B1 (See FIG. 19C and FIG. 20A). To this pixel, a data (−V2) is written in the horizontal scanning period S1 in frame F1. Now, the value of this pixel (the written value) is influenced by signal changes in the two data lines Lss, Lsn, to the extent (direction and magnitude) determined by the amounts of signal changes in the two data lines with respect to baselines provided by signal values of the feeding data line Lss and the adjacent data line Lsn respectively at the time the writing was made. Thus, here below, the amounts of signal change in the two data lines will be obtained with reference to FIGS. 20C–20E, with the baselines given by signal G1 (−V2) for the feeding data line and by signal B2 (−V1) for the adjacent data line.

Writing is made to the pixel of attention in the horizontal scanning period S1 in frame F1. During this period, obviously, the amount of signal change is zero in both of the feeding data line (signal G1) and the adjacent data line (signal B1). On the other hand, with a shift of the signal scanning period from S1 to S2, signal G1 changes from −V2 to +V1 whereas signal B1 changes from −V1 to +V2. Thus, the amount of signal change is +(V1+V2) in both of the feeding data line and the adjacent data line. Further, in the next horizontal scanning period S3, signal G1=−V2 and signal B1=−V1, i.e. the values come back to the signal values at the time the writing was made to this specific pixel. Therefore, the amount of signal change is zero in both of the feeding data line and the adjacent data line. Further, in the next horizontal scanning period S4, signal G1=+V1 and signal B1=+V2. Therefore, the amount of signal change is +(V1+V2) in both of the feeding data line and the adjacent data line, with respect to the baseline signal values (G1=−V2, B1=−V1) at the time the writing was made to this pixel. Likewise, the amount of signal change becomes zero in both of the feeding data line and the adjacent data line in the horizontal scanning period S5, and then becomes +(V1+V2) in both of the data lines in the horizontal scanning period S6.

After the frame is switched, i.e. in frame F2, a new pixel data is written in the horizontal scanning period S1 of frame F2. For the period of frame F2, attention will be paid to the pixel in the fifth row of Column G1 (the last pixel into which the data is written in frame F2), and a study will be made on how the value of this new pixel is influenced by signal changes in the feeding data line and in the adjacent data line. In this case, the amounts of signal change in the two data lines will be obtained in the same way as described above, with the baselines provided by a value of signal G1 (−V2) in the feeding data line and a value of signal B1 (−V1) in the adjacent data line at the time when the writing was made to the pixel in Column G1, Row 5 (in the horizontal scanning period S5 of frame F1). Specifically, with reference to FIGS. 20C and 20D, in the horizontal scanning period S1 of frame F2, the amount of signal change in the feeding data line (signal G1) is +2V2 whereas the amount of signal change in the adjacent data line (signal B1) is +2V1. In the horizontal scanning period S2, the amount of signal change in the feeding data line is +(V2−V1) whereas the amount of signal change in the adjacent data line is −(V2−V1). In the horizontal scanning period S3, the amount of signal change in the feeding data line is +V2 whereas the amount of signal change in the adjacent data line is +V1. In the horizontal scanning period S4, the amount of signal change in the feeding data line is +(V2−V1) whereas the amount of signal change in the adjacent data line is −(V2−V1). In the horizontal scanning period S5, the amount of signal change in the feeding data line is +V2 whereas the amount of signal change in the adjacent data line is +V1. In the horizontal scanning period S6, the amount of signal change in the feeding data line is +(V2−V1) whereas the amount of signal change in the adjacent data line is −(V2−V1).

As described above, with attention paid to pixels in Column G1, the amounts of signal change in the feeding data line and in the adjacent data line are as shown in FIG. 21A (not all data are shown), with respect to the baselines given by signal values in the respective data lines at the time the writing was made into these pixels. (Note that the pixel of attention in frame F1 is different from the one in frame F2.)

Next, attention will be paid to the borderline portion between the display units in black and the display units in white in the "checker back", i.e. to pixels in Column B1 (rows 1 and 5). For these pixels, the signal in their feeding data line Lss is B1 whereas the signal in the adjacent data line Lsn is R2. In this case, with reference to FIGS. 20D and 20E, the amounts of signal change in the feeding data line and in the adjacent data line are as shown in FIG. 21B, with respect to the baselines provided by signal values in the feeding data line and in the adjacent data line at the time when the writing was made to these pixels.

Now, attention will be turned to the pixels in Column G1. As shown in FIG. 21A, in frame F1 (before the frame is switched), signal changes are positive in both of the feeding data line and in the adjacent data line. This influences the pixel of attention (Column G1, Row 1) in such away that its value (−V2) is increased. On the other hand, when attention is turned to the pixel in Column B1, as shown in FIG. 21B, signal change is negative in both of the feeding data line and the adjacent data line in frame F1 (before the frame is switched). This influences the pixel of attention (Column B1, Row 1) in such a way that its value (+V2) is decreased. As described, in Column G1 and Column B1, the pixels of attention have the same absolute value but with different signs (−V2 vs. +V2) and accordingly, their amounts of signal change also have different signs (+(V1+V2) vs. −(V1+V2)). However, the changes are equal to each other in the absolute value, and hence will cause the same influence on a displayed image.

On the contrary, in frame F2 (after the frame is switched), as will be clearly understood by comparing the amounts of signal changes shown in FIG. 21A and in FIG. 21B, the pixel of attention in Column G1 (Row 5) and that in Column B1 (Row 5) are influenced differently by the signal changes in the feeding data line and in the adjacent data line. Specifically, after the frame is switched, the pixels of attention in Column G1 and in Column B1 are influenced in the same direction, or in such a way that their absolute values (−V2 vs. +V2) are generally decreased. Taking the following fact into consideration that V2 is sufficiently greater than V1, the pixels in Column B1 will be influenced to a greater extent than the pixels in Column G1. The pixels in Column R1 will be influenced practically as much as those in Column G1. Therefore, areas such as Column B1 that is influenced strongly by signal changes in the feeding data line and in the adjacent data line, i.e. the borderline area in the "checker back", will show the vertical shadow.

<True Dot Inversion Driving Method>

Next, a study will be made to displaying the "checker back" by way of the true dot inversion driving method in an active-matrix liquid crystal panel that has a common, non-staggered, structure. In this case, in one frame F1, the "checker back" is displayed under a polarity pattern as shown in FIG. 22A whereas in the next frame F2, the "checker back" is displayed under a polarity pattern as shown in FIG. 22B. Note that in this example, the liquid crystal panel does not have a staggered structure, and therefore, the effective number of the horizontal scanning lines is equal to the number of the scanning signal lines, which is five.

In this case, data signals G1, B1, R2 change as shown in FIGS. 22C–22E, with respect to the baseline provided by the counter electrode Ec. In these FIGS. 22C–22E, S1–S5 represent periods for which respective scanning signals SS1–SS5 shown in FIGS. 22A and 22B become active, i.e. the horizontal scanning periods in a frame. Here below, with reference to FIGS. 22C–22E, consideration will be made on how pixels of attention will be influenced by signal changes in the feeding data line and the adjacent data line.

First, as was in the above study on the quasi dot inversion driving method, consider influences on the pixels in Column G1 by signal changes in the feeding data line and the adjacent data line. For this purpose, attention is first made to a pixel in the first row of Column G1, and amounts of signal change in the two data lines will be obtained, with the baselines provided by a value (−V2) of signal G1 in the feeding data line and by a value (+V2) of signal B1 in the adjacent data line at the time when the writing was made into this pixel (in the horizontal scanning period S1 in frame F1). Next, attention will be paid to a pixel in the fifth row of Column G1, and amounts of signal change in the two data lines in frame F2 will be obtained, with the baselines given by a value (−V2) of signal G1 in the feeding data line and by a value (+V2) of signal B1 in the adjacent data line at the time when the writing was made into this pixel (in the horizontal scanning period S5 in frame F1). FIG. 23A shows these amounts of signal change in frames F1 and F2 obtained as described above. (Not all data are shown.)

Next, as was in the above study on the quasi dot inversion driving method, attention will be paid to pixels in Column B1 located on the borderline portion between the display units in black and the display units in white in the "checker back", and consideration will be made to influences on pixel values by signal changes in the feeding data line and the adjacent data line. For this purpose, attention is first made to a pixel in the first row of Column B1, and amounts of signal change in the two data lines will be obtained, with the baselines provided by a value (+V2) of signal B1 in the feeding data line and by a value (−V1) of signal R2 in the adjacent data line at the time when the writing was made into this pixel (in the horizontal scanning period S1 in frame F1). Next, attention will be paid to a pixel in the fifth row of Column B1, and amounts of signal change in the two data lines in frame F2 will be obtained, with the baselines given by a value (+V2) of signal B1 in the feeding data line and by a value (−V1) of signal R2 in the adjacent data line at the time when the writing was made into this pixel (in the horizontal scanning period S5 in frame F1). FIG. 23B shows these amounts of signal change in frames F1 and F2 obtained as described above. (Not all data are shown.)

Now, attention will be turned to the pixels in Column G1. As shown in FIG. 23A, in both of frames F1 and F2 (before and after the frame is switched), signal G1 in the feeding data line and signal B1 in the adjacent data line change in a "complementary" pattern. Specifically, with respect to the baseline provided by a signal value in relevant data lines at the time the writing was made into the pixel of attention, the signal values (voltage values) of the two data lines are in a relationship that when one increases the other decreases, and the amount of increase and the amount of decrease are the same in the absolute value. Therefore, influences from the two data lines via the respective parasitic capacities Csd (self) and Csd (other) canceled each other, and as a result, signal changes in the two data lines do not influence the value of the pixel of attention in Column G1.

Now, attention is turned to the pixels in Column B1. As shown in FIG. 23B, in frame F1 (before the frame is switched), signal B1 in the feeding data line and signal R2 in the adjacent data line change in a complementary pattern. However, in frame F2 (after the frame is switched), signals B1 and R2 in the two data lines do not change in a complementary pattern. Therefore, signal changes in the two data lines influences the value of the pixel in Column B1, via the parasitic capacities Csd (self) and Csd (other).

As described above, values of the pixels in Column G1 hold at intended values (as well as values of the pixels in Column R1), whereas values of the pixels in Column B1 on the border region in the "checker back" are altered from intended values, resulting in appearance of the vertical shadow in the liquid crystal panel screen.

<Summary of the Problems>

As described above, when a dot inversion driving method is utilized, even if the dot inversion driving method is a true dot inversion driving method, the vertical shadow appears when the "checker back" is displayed. In other words, whether the method is the quasi dot inversion driving method or the true dot inversion driving method, the "checker back" is a "killer pattern" that causes a problematic display pattern such as the vertical shadow. Although the driving method ideally should not have such a killer pattern, it is difficult at a practical level to realize a liquid crystal panel or a liquid crystal display based on such an ideal driving method. Also, as has been mentioned earlier, in view of practicability of the driving method, the quasi dot inversion driving method is advantageous over the true dot inversion driving method in that the withstand voltage required of the IC for the driving circuit can be lower in the quasi dot inversion driving method.

SUMMARY OF THE INVENTION

It is therefore an object of the present invention to provide a liquid crystal display having a staggered structure for a quasi dot inversion driving method, capable of reducing the vertical shadow when killer patterns such as the "checker back" is displayed.

An aspect of the present invention provides a liquid crystal display for displaying a color image. The display comprises:

a plurality of data signal lines;

a plurality of scanning signal lines intersecting the data signal lines; and a plurality of pixel-forming portions each related to one of the intersections made by the data signal lines and the scanning lines, and disposed in a matrix pattern.

Each of the pixel-forming portions includes:

a switching element turned on and off by the scanning signal line passing the related intersection and serving as a feeding scanning signal line;

a pixel electrode connected via the switching element to the data signal line passing the related intersection and serving as a feeding data signal line;

a counter electrode common to the pixel-forming portions for holding predetermined capacities between the counter electrode and the pixel electrodes; and a liquid crystal layer common to the pixel-forming portions, sandwiched between the pixel electrodes and the counter electrode.

With the above arrangement, a group of the pixel electrodes, or simultaneously-selected pixel electrodes, have their respective switching elements turned on and off by a same scanning signal line are assigned dispersedly to two mutually adjacent up and down rows of the matrix of pixel-forming portions, and in a horizontally periodical pattern having a cycle of "up, down, up" or "down, up, down" as to which of the up row and the down row is selected in the assignment of three pixel electrodes.

According to such an arrangement as the above, since the simultaneously-selected pixel electrodes are assigned dispersedly to two adjacent rows, it is possible to achieve a quasi dot inversion driving by inverting the voltage polarity for each horizontal scanning line (using a column electrode driving circuit built for the 1-H inversion driving). Further, it becomes possible to reduce the vertical shadow when displaying the "checker back" (a checker pattern), since the simultaneously-selected pixel electrodes are disposed in a horizontally periodical pattern having a cycle of "up, down, up" or "down, up, down" as to which of the up row and the down row is selected in the assignment of three pixel electrodes.

Such a liquid crystal display may further comprise: an output circuit outputting and thereby feeding the data signal lines with data signals for displaying the color image, with a polarity of voltage applied to the pixel electrode being the same for the simultaneously-selected pixel electrodes and being altered for each horizontal scanning period; and a delaying circuit selectively delaying the feeding of the data signal to the data signal lines feeding the pixel-forming portions including the simultaneously-selected pixel electrodes assigned to the up row of the two rows, by a single cycle of the horizontal scanning period.

According to such an arrangement as the above, due to the selective delay by the delaying circuit, the data signals are outputted to the data signal lines at a timing appropriate for the simultaneously-selected pixel electrodes disposed in the dispersed pattern (a modified staggered structure). Therefore, it becomes possible to display images of a quality as high as in a liquid crystal panel of a common, non-staggered, structure.

Another aspect of the present invention provides a liquid crystal display for displaying a color image. The display comprises:

a plurality of data signal lines;

a plurality of scanning signal lines intersecting the data signal lines; and a plurality of pixel-forming portions each related to one of the intersections made by the data signal lines and the scanning lines, and disposed in a matrix pattern.

Each of the pixel-forming portions includes:

a switching element turned on and off by the scanning signal line passing the related intersection and serving as a feeding scanning signal line;

a pixel electrode connected via the switching element to the data signal line passing the related intersection and serving as a feeding data signal line;

a counter electrode common to the pixel-forming portions for holding predetermined capacities between the counter electrode and the pixel electrodes; and a liquid crystal layer common to the pixel-forming portions, sandwiched between the pixel electrodes and the counter electrode.

With the above arrangement, a group of the pixel electrodes, or simultaneously-selected pixel electrodes, having their respective switching elements turned on and off by a same scanning signal line are assigned dispersedly to two mutually adjacent up and down rows of the matrix of pixel-forming portions, and in a horizontally periodical pattern having a cycle of "up, down, up, down, up, down, down, up, down, up, down, up" or "down, up, down, up, down, up, up, down, up, down, up, down" as to which of the up row and the down row is selected in the assignment of twelve pixel electrodes.

According to such an arrangement as the above, since the simultaneously-selected pixel electrodes are assigned dispersedly to two adjacent rows, it is possible to achieve a quasi dot inversion driving by using a column electrode driving circuit built for the 1-H inversion driving. Further, it becomes possible to reduce the vertical shadow both when displaying the "checker back" (the checker pattern) and when displaying the "horizontal stripe back" (a horizontal stripe pattern), since the simultaneously-selected pixel electrodes are disposed in a horizontally periodical pattern having a cycle of "up, down, up, down, up, down, down, up, down, up, down, up" or "down, up, down, up, down, up, up, down, up, down, up, down" as to which of the up row and the down row is selected in the assignment of twelve pixel electrodes.

Still another aspect of the present invention provides a column electrode driving circuit supplying data signals for displaying an image in a liquid crystal panel including: a plurality of data signal lines; a plurality of scanning signal lines intersecting the data signal lines; and a plurality of pixel-forming portions each related to one of the intersections made by the data signal lines and the scanning lines, and disposed in a matrix pattern. A group of the pixel electrodes, or simultaneously-selected pixel electrodes, included in the pixel-forming portions driven by a same scanning signal line are assigned dispersedly to two mutually adjacent up and down rows of the matrix of pixel-forming portions. The column electrode driving circuit comprises:

an output circuit outputting and thereby feeding the data signal lines with the data signals, with a polarity of voltage applied to the pixel electrode being the same for the simultaneously-selected pixel electrodes and being altered for each horizontal scanning period; and a delaying circuit selectively delaying the feeding of the data signal to the data signal lines feeding the pixel-forming portions including the simultaneously-selected pixel electrodes assigned to the up row of the two rows, by a single cycle of the horizontal scanning period.

According to such an arrangement as the above, due to the selective delay by the delaying circuit, the data signals are outputted to the data signal lines at a timing appropriate for the simultaneously-selected pixel electrodes disposed in the dispersed pattern in the liquid crystal panel. Therefore, it becomes possible to display images of a quality as high as in a liquid crystal panel of a common, non-staggered structure, in the liquid crystal panel of a staggered structure.

Still another aspect of the present invention provides a method of driving a liquid crystal panel, based on color image data. The liquid crystal panel includes: a plurality of data signal lines; a plurality of scanning signal lines intersecting the data signal lines; and a plurality of pixel-forming portions each related to one of the intersections made by the data signal lines and the scanning lines, and disposed in a matrix pattern. A group of the pixel electrodes, or simultaneously-selected pixel electrodes, included in the pixel-forming portions driven by a same scanning signal line are assigned dispersedly to two mutually adjacent up and down rows of the matrix of pixel-forming portions. The method comprises:

a scan driving step of feeding the scanning signal lines with scanning signals for alternate and sequential selection of one from the scanning signal lines for each horizontal scanning period;

a data driving step of feeding the data signal lines with data signals for displaying an image represented by the color image data, with a polarity of voltage applied to the pixel electrode being the same for the simultaneously-selected pixel electrodes and being altered for each horizontal scanning period; and a selection delaying step of selectively delaying the feeding of the data signal to the data signal lines feeding the pixel-forming portions including the simultaneously-selected pixel electrodes assigned to the up row of the two rows, by a single cycle of the horizontal scanning period.

With the above arrangement, the pixel-forming portions having their respective pixel electrodes assigned dispersedly to two mutually adjacent up and down rows of the matrix of pixel-forming portions and in a horizontally periodical pattern having a cycle of "up, down, up" or "down, up, down" as to which of the up row and the down row is selected in the assignment of three pixel electrodes are driven by a same scanning signal line in the scan driving step.

Still another aspect of the present invention provides a method of driving a liquid crystal panel, based on color image data. The liquid crystal panel includes: a plurality of data signal lines; a plurality of scanning signal lines intersecting the data signal lines; and a plurality of pixel-forming portions each related to one of the intersections made by the data signal lines and the scanning lines, and disposed in a matrix pattern. A group of the pixel electrodes, or simultaneously-selected pixel electrodes, included in the pixel-forming portions driven by a same scanning signal line are assigned dispersedly to two mutually adjacent up and down rows of the matrix of pixel-forming portions. The method comprises:

a scan driving step of feeding the scanning signal lines with scanning signals for alternate and sequential selection of one from the scanning signal lines for each horizontal scanning period;

a data driving step of feeding the data signal lines with data signals for displaying an image represented by the color image data, a polarity of voltage applied to the pixel electrode being the same for the simultaneously-selected pixel electrodes and being altered for each horizontal scanning period; and a selection delaying step of selectively delaying the feeding of the data signal to the data signal lines feeding the pixel-forming portions including the simultaneously-selected pixel electrodes assigned to the up row of the two rows, by a single cycle of the horizontal scanning period.

With the above arrangement, the pixel-forming portions having their respective pixel electrodes assigned dispersedly to two mutually adjacent up and down rows of the matrix of pixel-forming portions and in a horizontally periodical pattern having a cycle of "up, down, up, down, up, down, down, up, down, up, down, up" or "down, up, down, up, down, up, up, down, up, down, up, down" as to which of the up row and the down row is selected in the assignment of twelve pixel electrodes are driven by a same scanning signal line in the scan driving step.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 4A–4K are timing charts showing an operation of the column electrode driving circuit according to the first embodiment.

FIGS. 6A–6E are timing charts for describing an operation when the "checker back" is displayed according to the first embodiment.

FIGS. 6F–6H show signal waveforms for describing the operation when the "checker back" is displayed according to the first embodiment.

FIGS. 8A and 8B show amounts of signal change in a feeding data line and an adjacent data line of a pixel when the "checker back" is displayed according to the first embodiment.

FIGS. 10A and 10B show amounts of signal change in a feeding data line and an adjacent data line of a pixel when the "horizontal stripe back" is displayed by way of quasi dot inversion driving method based on the modified staggered structure of the three-column period.

FIGS. 12A and 12B show amounts of signal change in a feeding data line and an adjacent data line of a pixel when the "horizontal stripe back" is displayed by way of quasi dot inversion driving method based on the common staggered structure.

FIGS. 20A and 20B are schematic diagrams of a liquid crystal panel for describing why the vertical shadow appears when the "checker back" is displayed by way of quasi dot inversion driving method based on a common staggered structure.

FIGS. 20C–20E show signal waveforms for describing why the vertical shadow appears when the "checker back" is displayed by way of quasi dot inversion driving method based on the common staggered structure.

FIGS. 21A and 21B show amounts of signal change in the feeding data line and the adjacent data line of a pixel when the "checker back" is displayed by way of quasi dot inversion driving method based on the common staggered structure.

FIGS. 22A and 22B are schematic diagrams of a liquid crystal panel for describing why the vertical shadow appears when the "checker back" is displayed by way of conventional true dot inversion driving method.

FIGS. 22C–22E show signal waveforms for describing why the vertical shadow appears when the "checker back" is displayed by way of conventional true dot inversion driving method.

FIGS. 23A and 23B show amounts of signal change in the feeding data line and the adjacent data line of a pixel when the "checker back" is displayed by way of conventional true dot inversion driving method.

DESCRIPTION OF THE PREFERRED EMBODIMENTS

Hereinafter, embodiments of the present invention will be described with reference to the accompanying drawings.

<1. First Embodiment>

<1.1. Overall Construction and Operation>

Figure 1A:
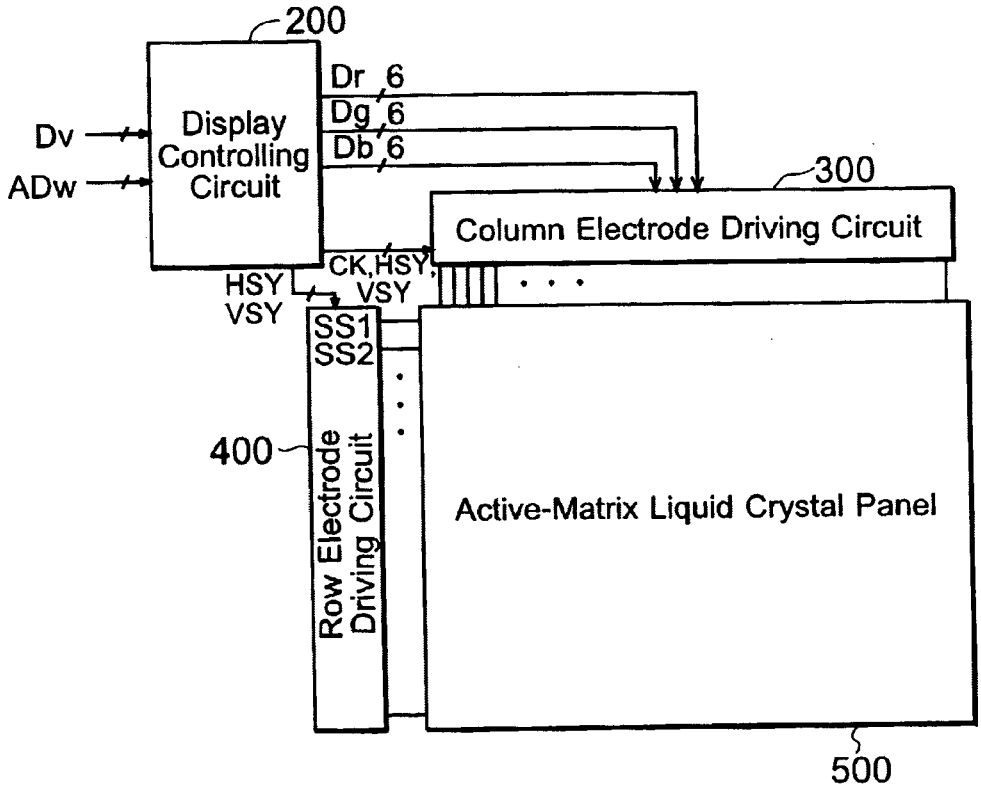
FIG. 1A is a block diagram of a liquid crystal display according to a first embodiment of the present invention.

FIG. 1A is a block diagram of a liquid crystal display according to a first embodiment of the present invention. This liquid crystal display is for displaying color images, and comprises a display controlling circuit (generally "called LCD controller") 200, a column electrode driving circuit 300, a row electrode driving circuit 400 and an active-matrix liquid crystal panel 500.

The liquid crystal panel 500, serving as a display screen in this liquid crystal display, includes a plurality of scanning signal lines (row electrodes), a plurality of data lines (column electrodes) crossing each of the scanning signal lines, and a plurality of pixel-forming portions formed correspondingly to each of the intersections made by the scanning signal lines and the data lines. Images, made of a plurality of horizontal scanning lines each corresponding to one of the scanning signal lines of the liquid crystal panel, are supplied from e.g. a CPU of an external computer, in the form of image data Dv. Each pixel-forming portion has generally the same construction as of the conventional active-matrix liquid crystal panel. (More details to be described later.)

According to the present embodiment, a CPU of an external computer for example, sends to the display controlling circuit 200 image data (in a narrow sense) of an image to be displayed in the liquid crystal panel 500 as well as other data (hereinafter called "display control data") for e.g. determining display timing (such as display clock frequency data). (Hereinafter, these data Dv sent from outside will be called "image data in the broad sense".) In other words, the external CPU supplies the display controlling circuit 200 with the image data Dv in the broad sense which includes the image data in the narrow sense and the display control data, together with address signals ADw, and thereby writes these data into a display memory and a register, which will be described later, in the display controlling circuit 200.

Based on the display control data written into the register, the display controlling circuit 200 generates display clock signal CK, horizontal synchronizing signal HSY, vertical synchronizing signal VSY and so on. Further, the display controlling circuit 200 reads the display memory, picks up the image data (in the narrow sense) written by e.g. an external CPU, and outputs the data in the form of three digital image signals Dr, Dg, Db. The digital image signal Dr is an image signal representing the color red of the given image (and thus, hereinafter called "red image signal"). The digital image signal Dg is an image signal representing the color green of the given image (hereinafter called "green image signal"). The digital image signal Db is an image signal representing the color blue of the given image (hereinafter called "blue image signal"). Among those signals generated by the display controlling circuit 200, the clock signal Ck is supplied to the column electrode driving circuit 300, the horizontal synchronizing signal HSY and the vertical synchronizing signal VSY are supplied to the column electrode driving circuit 300 and the row electrode driving circuit 400, and the digital image signals Dr, Dg, Db are supplied to the column electrode driving circuit 300. It should be noted here that if the number of gradation levels for the image is 64, each of the digital image signals Dr, Dg, Db is a 6-bit signal and therefore the number of signal lines coming out of the display controlling circuit 200 to the column electrode driving circuit 300 for the supply of the digital image signals Dr, Dg, Db is: 6×3=18.

As described, the column electrode driving circuit 300 is supplied with the data representing an image to be displayed in the liquid crystal panel 500, serially for each pixel in the form of the digital image signals Dr, Dg, Db, and at the same time supplied with timing signals including the clock signal CK, the horizontal synchronizing signal HSY and the vertical synchronizing signal VSY. Based on these digital image signals Dr, Dg, Db, the clock signal CK, the horizontal synchronizing signal HSY and the vertical synchronizing signal VSY, the column electrode driving circuit 300 generates image signals for driving the liquid crystal panel 500 (hereinafter called "data signals"), and feeds the signals to each data line of the liquid crystal panel 500.

Based on the horizontal synchronizing signal HSY and the vertical synchronizing signal VSY, the row electrode driving circuit 400 generates scanning signals (SS1, SS2, . . . ) to be fed to respective scanning signal lines in the liquid crystal panel 500 for alternate and sequential selection of the scanning signal lines for each horizontal scanning period, and repeats a cycle of feeding one of the scanning signal lines with the active scanning signal for the sequential selection of all the scanning signal lines, during each vertical scanning period.

Thus, in the liquid crystal panel 500, the data lines are fed with data signals based on the digital image signals Dr, Dg, Db from the column electrode driving circuit 300 whereas the scanning signal lines are fed with scanning signals from the row electrode driving circuit 400. In this way, the crystal panel 500 displays color images carried by the image data Dv sent from e.g. an external CPU.

<1.2. Display Controlling Circuit>

Figure 1B:
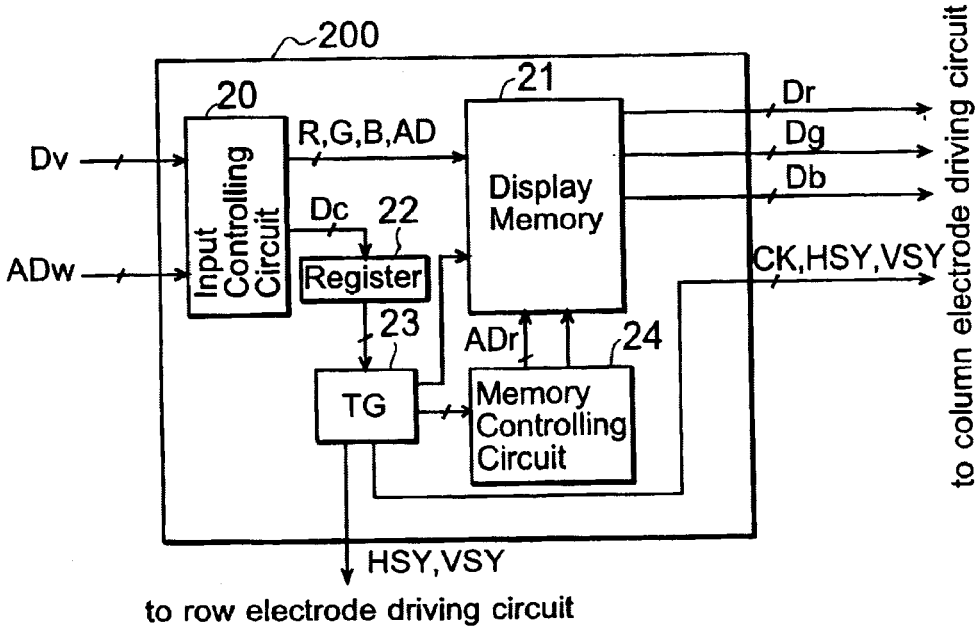
FIG. 1B is a block diagram of a display controlling circuit according to the first embodiment.

FIG. 1B is a block diagram of the display controlling circuit 200 in the liquid crystal display. The display controlling circuit 200 includes an input controlling circuit 20, a display memory 21, a register 22, a timing generation circuit 23 and a memory controlling circuit 24.

The display controlling circuit 200 receives a signal that carries the image data Dv in the broad sense (Hereinafter, this signal itself will also be indicated by the reference symbol "Dv") and the address signal ADw from e.g. an external CPU, and inputs these signals to the input controlling circuit 20. The input controlling circuit 20 divides the image data Dv in the broad sense into three kinds of color image data R, G, B and a display controlling data Dc, based on the address signal ADw. The input controlling circuit 20 then send signals representing the color image data R, G, B (Hereinafter, these signals will also be indicated by the codes "R", "G" and "B" respectively.) to the display memory 21 together with address signals AD which are based on the address signal ADw, thereby writing the three kinds of image data R, G, B into the display memory 21, and the display controlling data Dc into the register 22. Here, the three kinds of image data R, G, B are data representing the red color component, the green color component and the blue color component of the image contained in the image data Dv. The display controlling data Dc includes frequency data of the clock signal CK and timing data specifying the horizontal scanning period and the vertical scanning period for displaying the image contained in the image data Dv.

The timing generation circuit (hereinafter abbreviated as TG) 23 generates the clock signal CK, the horizontal synchronizing signal HSY and the vertical synchronizing signal VSY, based on the above display controlling data held in the register 22. TG 23 also generates timing signals that allow the display memory 21 and the memory controlling circuit 24 to operate in synchronization with the clock signal CK.

The memory controlling circuit 24 generates address signal ADr and signals for controlling the operation of the display memory 21. The address signal ADr is necessary for reading image data representing actual image to be displayed in the liquid crystal panel 500, out of the image data R, G, B which are inputted from outside and stored in the display memory 21 via the input controlling circuit 20. These address signal Adr and the control signals are given to the display memory 21, whereby data indicating the red color component, the green color component and the blue color component of the image to be displayed in the liquid crystal panel 500 are read out as red image signal Dr, green image signal Dg and blue image signal Db from the display memory 21 and outputted from the display controlling circuit 200. The three kinds of signals, i.e. digital image signals Dr, Dg, Db, are supplied to the column electrode driving circuit 300 as mentioned earlier.

<1.3. Liquid Crystal Panel>

Figure 2A:
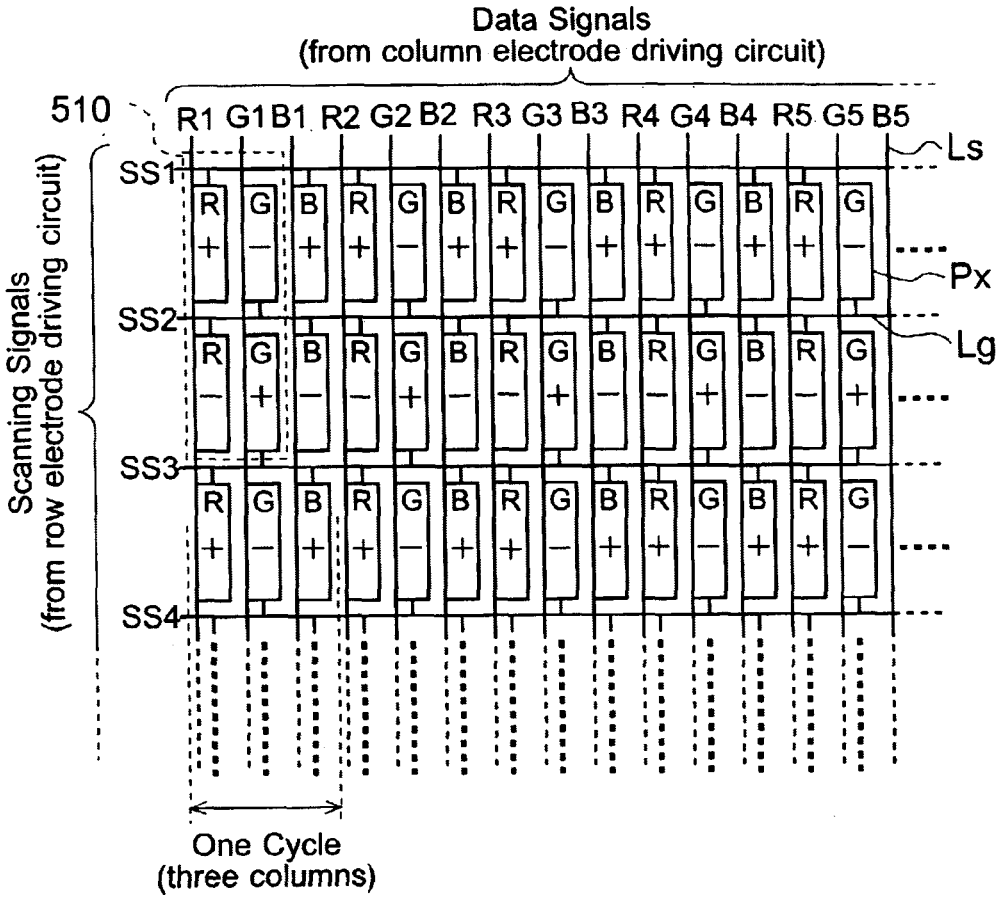
FIG. 2A is a schematic diagram showing an arrangement in the liquid crystal display panel according to the first embodiment.
Figure 2B:
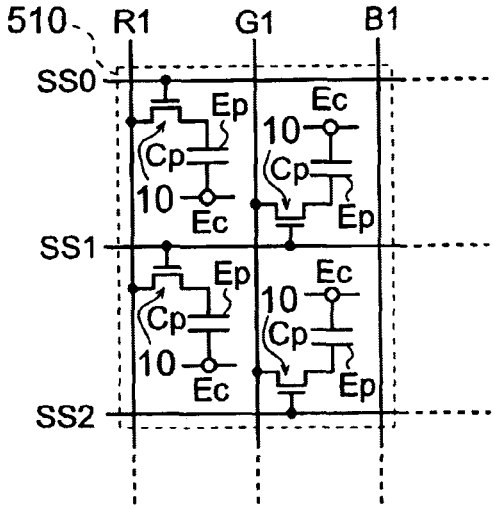
FIG. 2B is an equivalent circuit diagram of a part (for four pixels) of the liquid crystal display panel according to the first embodiment.

FIG. 2A is a schematic diagram showing an arrangement in the liquid crystal display panel 500 according to the present embodiment. FIG. 2B is an equivalent circuit diagram of a part (for four pixels) 510 of the liquid crystal display panel 500. In these figures, reference symbols Rj, Gj, Bj (j=1, 2, 3, . . . ) indicate data signals fed to respective data lines, and also indicate the columns of the pixels (columns of the pixel-forming portions) into which the data are written by the respective data lines. Further, reference symbols SS1, SS2, SS3, . . . indicate scanning signals fed to respective scanning signal lines Lg.

Figure 19A:
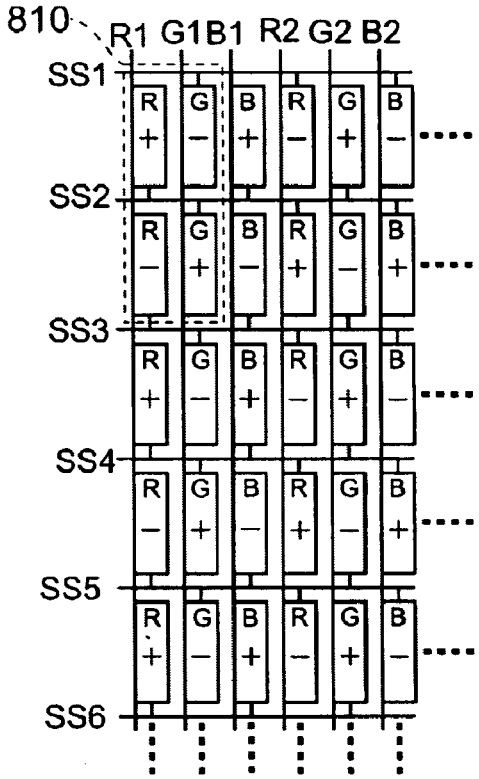
Fig. 19A PRIOR ART
FIG. 19A is a schematic diagram of a liquid crystal panel according to a conventional staggered structure for quasi dot inversion driving method
Figure 19B:
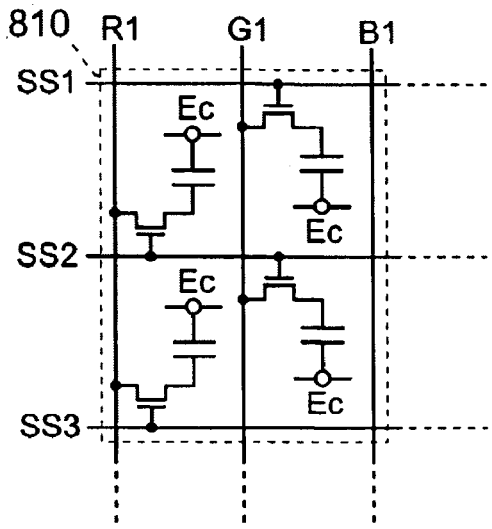
Fig. 19B PRIOR ART
FIG. 19B is an equivalent circuit diagram of a part (for four pixels) of a liquid crystal display panel of the conventional staggered structure for quasi dot inversion driving method.
Figure 19C:
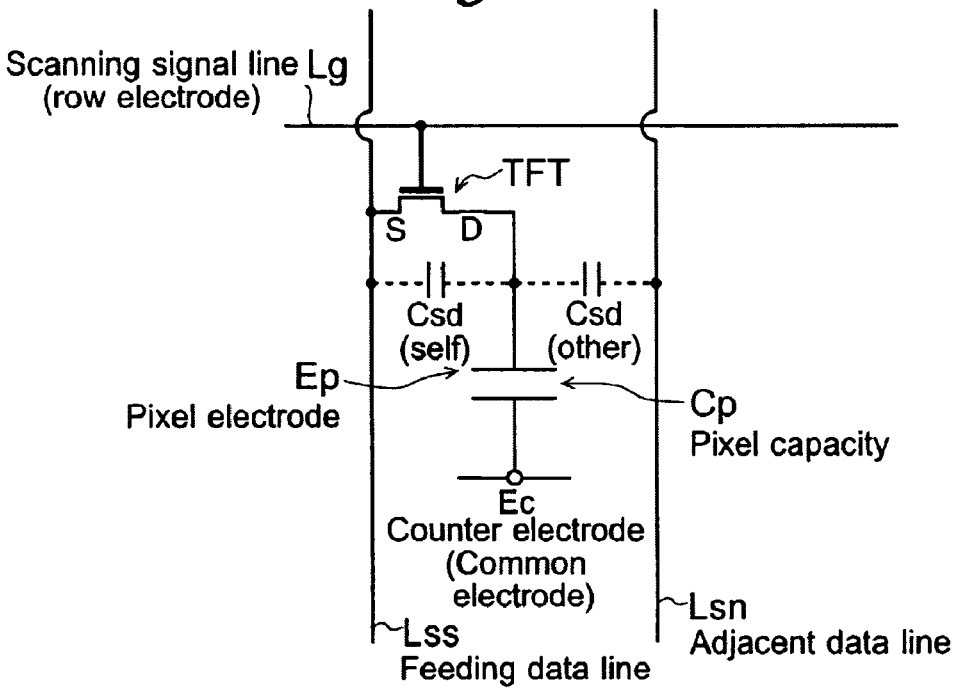
FIG. 19C is an equivalent circuit diagram of a pixel-forming portion in the liquid crystal display panel.

The liquid crystal panel 500 includes a plurality of data lines Ls each connected to one of output terminals of the column electrode driving circuit 300, and a plurality of scanning signal lines Lg each connected to one of output terminals of the row electrode driving circuit 400. The data lines Ls and the scanning signal lines Lg are laid in a grid pattern so that each data line Ls intersects each scanning signal line Lg. As described earlier, a plurality of pixel-forming portions Px are formed correspondingly to respective intersections made by the data lines Ls and the scanning signal lines Lg. Each pixel-forming portion Px has a construction as shown in FIG. 2B. Specifically, the construction is similar to the convention (as in FIG. 19C), including a TFT 10 having its source terminal connected to the feeding data line Ls which is a data line that passes the relevant intersection, a pixel electrode Ep connected to the drain terminal of the TFT 10, a counter electrode Ec serving as an electrode common to all of the pixel-forming portion Px, and a liquid crystal layer sandwiched between the pixel electrode Ep and the counter electrode Ec. With this construction, the pixel electrode Ep, the counter electrode Ec and the liquid crystal layer sandwiched in between form a pixel capacity Cp. The pixel-forming portion is sandwiched by two data lines Ls, and there is a parasitic capacity Csd (self) between one of the data lines serving as the feeding data line and the pixel electrode Ep. Further, there is another parasitic capacity Csd (other) between the other of the data lines which is the adjacent data line and the pixel electrode Ep (See FIG. 19C). Note that description will be made on the same premise as in the convention, i.e. Csd (self)=Csd (other).

The pixel-forming portions Px as described above are laid in a matrix, forming a pixel-forming matrix. Accordingly, the pixel electrodes Ep in the pixel-forming portions Px form a pixel electrode matrix. In the pixel electrode matrix, rows of the pixel electrodes running vertically and the data lines Ls running vertically are alternated with each other in the horizontal direction. Rows of the pixel electrodes running horizontally and the scanning signal lines Lg running horizontally are alternated with each other in the vertical direction. It should be appreciated that the pixel electrode, which is a primary portion of the pixel-forming portion, has a one-to-one relationship with, and can be regarded as, a pixel of the image displayed in the liquid crystal panel 500. Thus, hereinafter, the pixel-forming portions Px will be regarded as the pixels for simplicity of description, and the term "pixel matrix" will indicate the "pixel-forming matrix" or the "pixel electrode matrix". Note further, that according to the liquid crystal panel 500, three pixels adjacent in the horizontal direction for respective colors of red (R), green (G) and blue (B) serve as a unit of display.

According to the present embodiment, those pixel electrodes Ep connected to the TFTs turned on and off by the same scanning signal line Lg are not located in the same pixel row of the pixel matrix, but located dispersedly in two pixel rows that are adjacent to each other. In other words, in a given row of the pixels in the pixel matrix, not all pixel electrodes have the gate terminals of their respective TFTs 10 connected to the same scanning signal line, but the connection is made in a dispersed pattern, to two scanning signal lines sandwiching the pixel row. In this regard, the structure of the liquid crystal panel according to the present embodiment can be regarded as a staggered structure.

However, according to the liquid crystal panel offered by the present embodiment, as shown in FIG. 2A, the pixel electrodes Ep connected to the TFTs turned on and off by the same scanning signal line Lg are located in two pixel rows which are mutually adjacent in a vertical relationship, and in a horizontally periodical pattern having a cycle of "down, up, down" as to which of the upper row and the lower row is selected in the assignment of three pixel electrodes. Specifically, take the scanning signal line fed with the scanning signal SS2 (the second scanning signal line from the top) for example, and see how those pixel electrodes Ep connected to the TFTs 10 which are turned on and off by this particular signal line are assigned to the first pixel row (hereinafter called "up row") and to the second pixel row (hereinafter called "down row"). When looking sequentially from the left in the figure (in the order of Column R1, Column G1, Column B1 . . . ), the cycle pattern of down row, up row, down row, down row, up row, down row . . . will be found.

As understood, the liquid crystal panel according to the present embodiment differs from the conventional staggered structure (FIGS. 19A and 19B) in which the pixel electrodes connected to the TFTs turned on and off by the same scanning signal line are located alternately in two mutually adjacent pixel rows. Specifically, the structure according to the present invention has a periodic cycle of three pixel rows, as to which of the up row and the down row is selected in the assignment of three pixel electrodes. Hereinafter, this matrix structure according to the present embodiment will be called "three-column-cycle staggered structure" whereas the conventional staggered structure will be called "common staggered structure". It should be noted that according to the example shown in FIG. 2A, the pixel electrodes Ep connected to the TFTs turned on and off by the same scanning signal line Lg are located in a cycle pattern of "down, up, down". However, the cycle pattern may alternatively be "up, down, up". Note further, that the term "down, up, down" or "up, down, up" are expressions with respect to the direction in which the scanning signal line runs. In a common liquid crystal panel, the scanning signal lines run in the direction of the row, and therefore, the location of a pixel electrode with respect to the scanning signal lines will be understood obviously by the term "up row" and "down row". There can be cases that the scanning signal lines run in the direction of the column (e.g. a case where a typical liquid crystal panel is rotated by 90 degrees). Even in such a case, the location of the pixel electrode can be clearly indicated by the term "up row" and "down row" as far as the indication is made with respect to the direction in which the scanning signal lines run.

In FIG. 2A, a plus sign "+" accompanying a pixel-forming portion Px indicates that a positive electric voltage is applied to the pixel liquid-crystal (or the pixel electrode) in the pixel-forming portion Px. Likewise, a minus sign "−" indicates that a negative electric voltage is applied to the pixel liquid-crystal (or pixel electrode) in the pixel-forming portions Px. The "+" and "−" symbols in the pixel-forming portions Px show a polarity pattern in the pixel matrix. A polarity pattern shown in FIG. 2A is one of such patterns in a frame when the liquid crystal panel 500 of the three-column-cycle staggered structure is driven by a column electrode driving circuit built for the 1-H inversion driving.

<1.4. Column Electrode Driving Circuit>

As described above, according to the present embodiment, all of the pixel electrodes connected to the TFTs having their gate terminals connected to the same scanning signal line in the liquid crystal panel 500, namely, the pixel electrodes connected to the TFTs turned on and off by the same scanning signal line (hereinafter called "simultaneously-selected pixel electrodes"), are not located in the same pixel row, but in a dispersed pattern in two mutually adjacent pixel rows. Given such a dispersed pattern in the location of the simultaneously-selected pixel electrodes, the column electrode driving circuit 300 must supply proper data signals Rj, Gj, Bj (j=1, 2, 3, . . . ) corresponding to values of respective pixels. The column electrode driving circuit 300 according to the present embodiment solves such a challenge from the dispersed location of the simultaneously-selected pixel electrodes by using an arrangement as shown in FIG. 2A, making it possible to output data signals and feed each data signal line at an appropriate timing for the three-column-cycle staggered structure.

Figure 3:
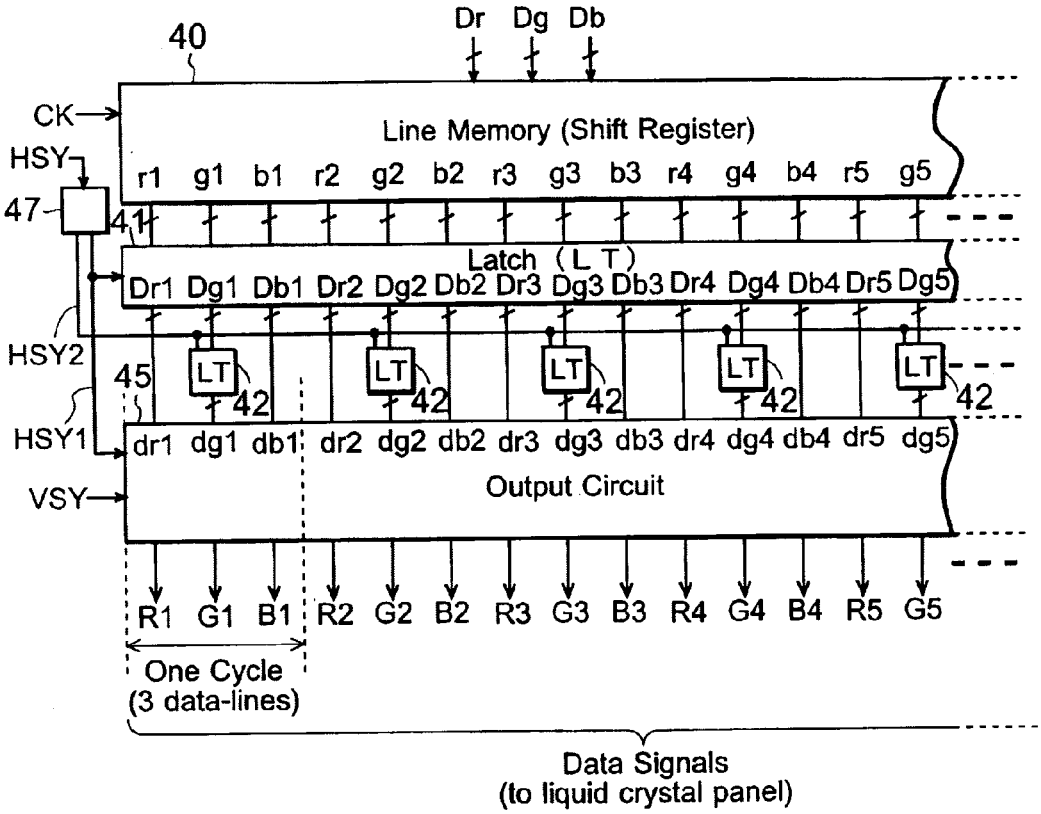
FIG. 3 is a block diagram of a column electrode driving circuit according to the first embodiment.

FIG. 3 is a block diagram showing such an arrangement in the column electrode driving circuit 300. This column electrode driving circuit 300 includes: a line memory 40 provided by a shift register and serving as serial/parallel converting means; a latch circuit 41 serving as holding means or a holding circuit that holds a line of an image data for a single cycle of the horizontal scanning period; a latch circuit 42 serving as delaying means or a delaying circuit that delays an inputted signal by a single cycle of the horizontal scanning period; an output circuit 45 which generates data signals to be fed to the data lines Ls of the liquid crystal panel 500, based on the inputted signals; and a gate signal generating circuit 47 which generates a first and a second gate signals HSY1, HSY2 to be fed to the respective latch circuits 41 and 42, based on the horizontal synchronizing signal HSY. It should be noted here that the first and the second gate signals HSY1, HSY2 both have the same pulse period as the horizontal synchronizing signal HSY. As shown in FIGS. 4A and 4B, the first gate signal HSY1 is made by delaying the second gate signal HSY2 for a predetermined amount of time sufficiently shorter than the horizontal scanning period. The latch circuit 41 as the holding means or the holding circuit takes and outputs an input signal value when the first gate signal HSY1 assumes level H (high level). On the other hand, when the first gate signal HSY1 assumes level L (low level), the latch circuit 41 holds and outputs an input signal value right before the level was changed to the level L. The latch circuit 42 as the delaying means or the delaying circuit takes and outputs an input signal value when the second gate signal HSY2 assumes level H, but when the second gate signal HSY2 assumes level L, holds and outputs an input signal value right before the level was changed to the level L.

The line memory 40 is serially fed with digital image signals Dr, Dg, Db as shown in FIGS. 4C–4E for each of the pixels, in synchronization with the clock signal CK. (In FIGS. 4A–4K, reference symbols "rij", "gij" and "bij" indicate pixel data representing a red color component, a green color component and a blue color component respectively in the j-th block in the i-th line.) The line memory 40 can store a horizontal line of pixel data, and sequentially takes these digital image signals Dr, Dg, Db based on the clock signal CK, and then makes a parallel output of the signals as first internal image signals rj, gj, bj (j=1, 2, 3, . . . ). The first internal image signals rj, gj, bj are inputted to the latch circuit 41 serving as the holding means or the holding circuit.

The latch circuit 41 works on the bases of the first gate signal HSY1 shown in FIG. 4A, takes and holds the values of the first internal image signals rj, gj, bj for a single cycle of the horizontal scanning period, and then outputs second internal image signals Drj, Dgj, Dbj (j=1, 2, 3, . . . as shown in FIGS. 4F–4H. The second internal image signals Drj, Dgj, Dbj are inputted to the output circuit 45 as third internal image signals drj, dgj, dbj (j=1, 2, 3, . . . directly or via the delay means (the delay circuit).

In the above, when the latch circuit 41 serving as the holding means or the holding circuit outputs the second internal image signals Drj, Dgj, Dbj, those signals for Columns G1, G2, G3, . . . are inputted to the output circuit 45 via the latch circuit 42 serving as the delay means or the delay circuit whereas the other internal image signals are inputted directly to the output circuit 45. The latch circuit 42 works on the bases of the second gate signal HSY2 shown in FIG. 4B, and delays the second internal image signals Dg1, Dg2, Dg2 for Columns G1, G2, G3, . . . by a single cycle of the horizontal scanning period. Now, in the context of the simultaneously-selected pixel electrodes laid in the dispersed pattern in two mutually adjacent, up and down pixel rows, this delay means that a delay for one cycle of horizontal scanning period has been made for a data signal to be supplied by a data line to those dispersedly located pixel electrodes assigned to and included in pixel-forming portions in the up row. In other words, according to the liquid crystal panel 500 in which each of the pixel-forming portions Px (the pixel electrodes) is sandwiched by an upper and a lower scanning signal lines Lg, and a group of the pixel-forming portions have the gate terminals of their respective TFTs 10 connected to the lower scanning signal line, pixel values carried in the second internal image signals Dg1, Dg2, Dg3 for the pixel-forming portions that include these TFTs 10 (see FIG. 2A), are delayed for a cycle of the horizontal scanning period, and inputted as the third internal image signals dg1, dg2, dg3 to the output circuit 45 (FIG. 4J).

The output circuit 45 works on the basis of the third internal image signals drj, dgj, dbj (j=1, 2, 3, . . . ) as described above, and generates data signals Rj, Gj, Bj (j=1, 2, 3, . . . ) to be fed to each of the data lines Ls of the liquid crystal panel 500. In the generation, the output circuit 45 inverts polarity of the data signals Rj, Gj, Bj, i.e. positive-negative polarity of the electric voltage to be applied to the liquid crystal panel 500, for each horizontal scanning period, based on the first gate signal HSY1 which serves as an equivalent of the horizontal synchronizing signal HSY, and further, for each frame period, based on the vertical synchronizing signal VSY.

<1.5. Displaying the "Checker Back">

Figure 5A:
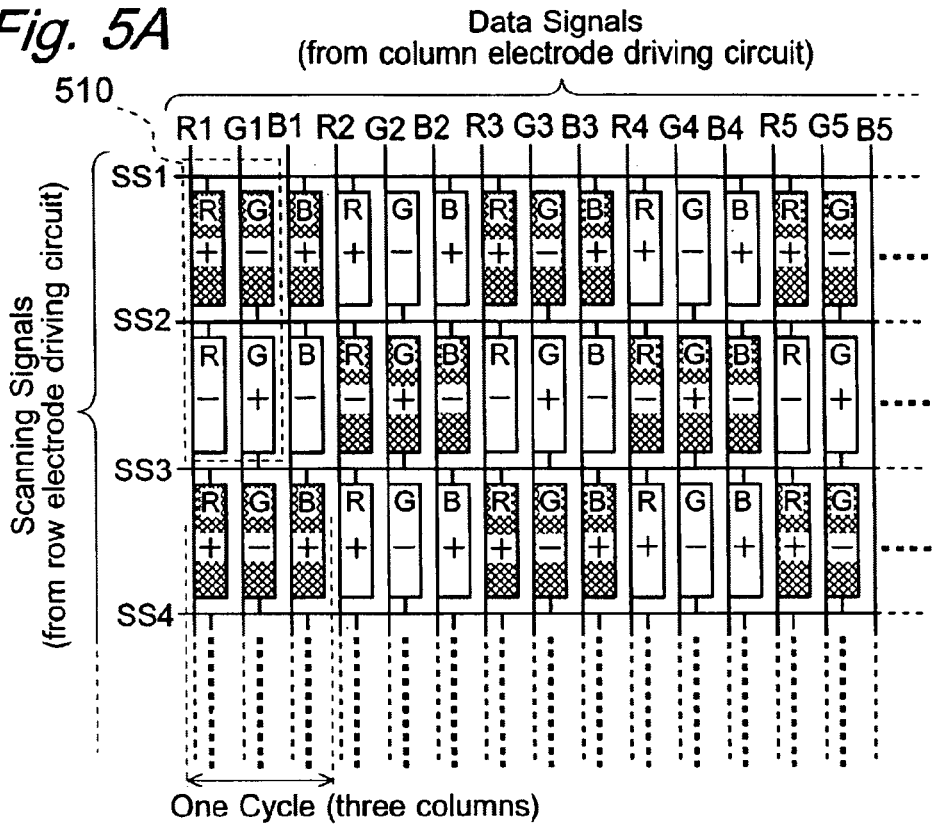
FIGS. 5A and 5B are schematic diagrams showing polarity patterns when the "checker back" is displayed in the liquid crystal panel according to the first embodiment.
Figure 5B:
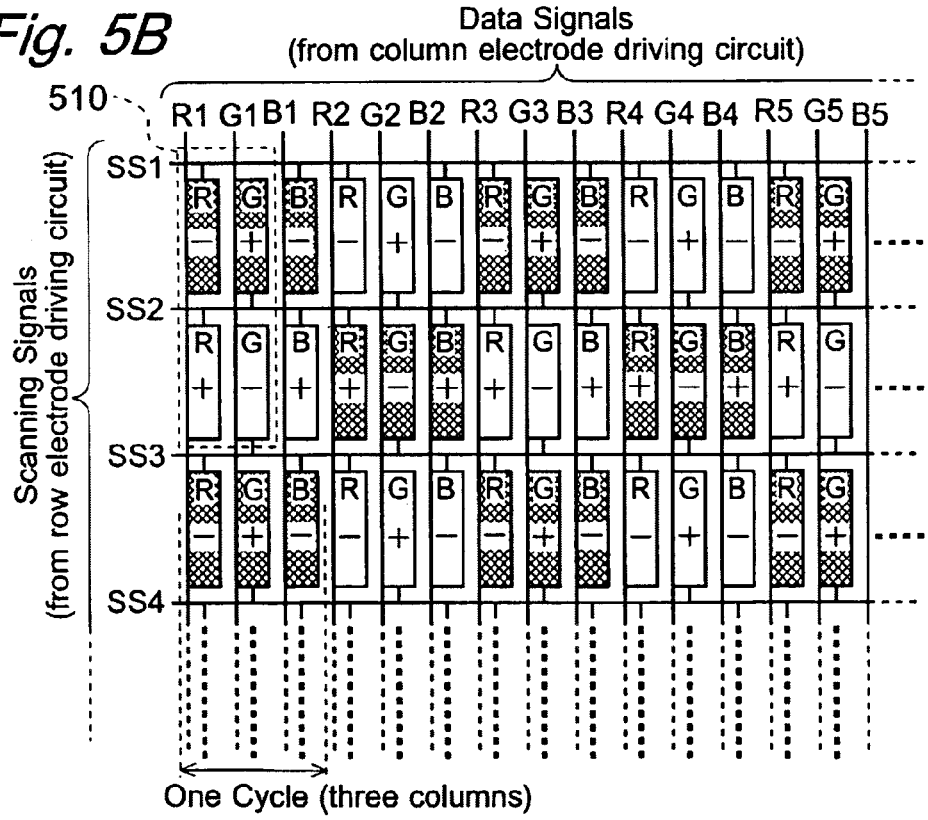
Figure 24A:
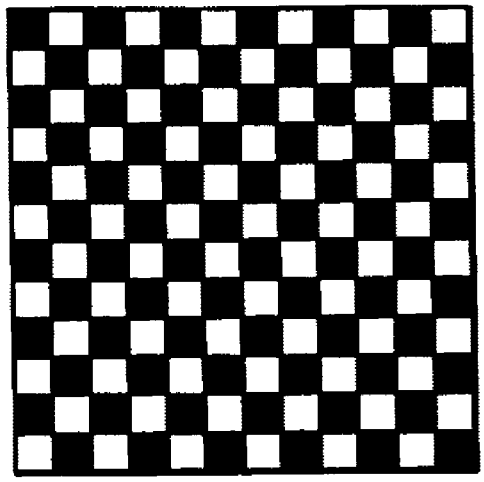
FIG. 24A shows the "checker back" which is a pattern that causes the vertical shadow (killer pattern).

Next, description will be made for an operation of the liquid crystal display according to the present embodiment when displaying the "checker back" as shown in FIG. 24A. In the operation, the "checker back" is displayed under a polarity pattern as shown in FIG. 5A in one frame F1 whereas in the next frame F2, the "checker back" is displayed under a polarity pattern as shown in FIG. 5B. Note that in FIGS. 5A and 5B, crosshatched pixel-forming portions (pixels) indicate that the display is made in black whereas the pixel-forming portions without the crosshatch indicate that the display is made in white. Each of the black block and the white block is formed by using a unit of display that includes mutually adjacent three pixels representing the colors of R (red), G (green) and B (blue). The white block and the black block are alternated with each other in the horizontal and the vertical directions.

In this case, the output circuit 45 of the column electrode driving circuit 300 is fed with the third internal image signals dr1, dg1, db1 as shown in FIGS. 6C–6E. Throughout FIGS. 6C–6E, crosshatched rectangles represent pixel data for displaying the black color whereas rectangles without the crosshatch represent pixel data for displaying the white color. The output circuit 45 works on the basis of the third internal image signals dr1, dg1, db1 as the above, the vertical synchronizing signal VSY (FIG. 6A), and the first gate signal HSY1 (FIG. 6B) serving as the horizontal synchronizing signal, and generates data signals R1, G1, B1 as shown in FIGS. 6F–6H. Throughout FIGS. 6F–6H, symbols "+V1" and "−V1" indicate a positive voltage and a negative voltage respectively to be applied to each of the pixel liquid-crystals, i.e. a part of the liquid crystal layer that provides the pixel, for displaying the white color. Likewise, symbols "+V2" and "−V2" indicate a positive voltage and a negative voltage respectively to be applied to those pixel liquid-crystals, for displaying the black color. (The same will apply hereinafter.)

As understood from FIGS. 6F–6H, according to the present embodiment, the column electrode driving circuit 300 uses the 1-H inversion driving method for driving the liquid crystal panel 500, but as shown in FIGS. 5A–5B, the liquid crystal panel has the three-column-cycle staggered structure. Therefore, the polarity pattern has a periodic cycle of "+, −, +" or "−, +, −" in the horizontal direction. In this way, the present embodiment achieves a quasi dot inversion driving based on the three-column-cycle staggered structure.

Figure 7A:
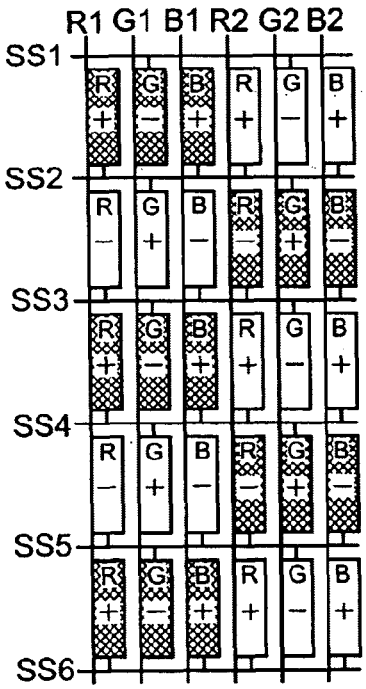
FIGS. 7A and 7B are schematic diagrams of a liquid crystal panel for a study if the vertical shadow appears when the "checker back" is displayed according to the first embodiment.
Figure 7B:
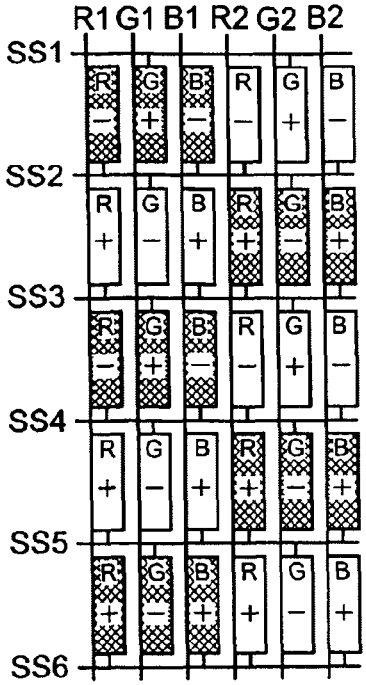

Next, a study will be made on whether the vertical shadow will appear or not when the "checker back" is displayed as in the above. For convenience, the following study will use a liquid crystal panel having the three-column-cycle staggered structure, including only 6×5 pixels served by five effective horizontal scanning lines and six data lines. (Note that in the staggered structure, the number of scanning signal lines is six, or one more than the effective number of horizontal scanning lines.) When displaying the "checker back" in such a liquid crystal panel as the above, the "checker back" is displayed under a polarity pattern as shown in FIG. 7A in one frame F1 whereas and in the next frame F2, the "checker back" is displayed under a polarity pattern as shown in FIG. 7B.

Figure 7C:
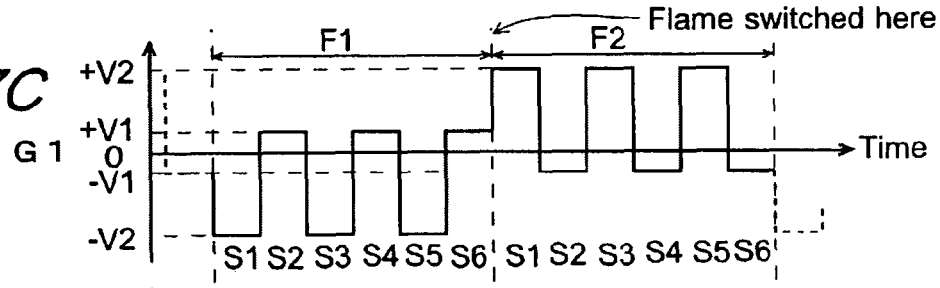
FIGS. 7C and 7E show signal waveforms of a liquid crystal panel for a study if the vertical shadow appears when the "checker back" is displayed according to the first embodiment.
Figure 7D:
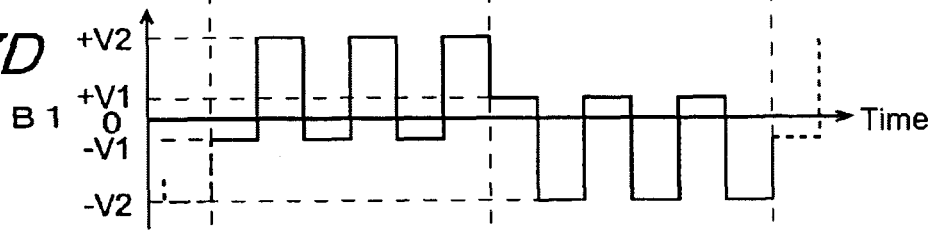
Figure 7E:
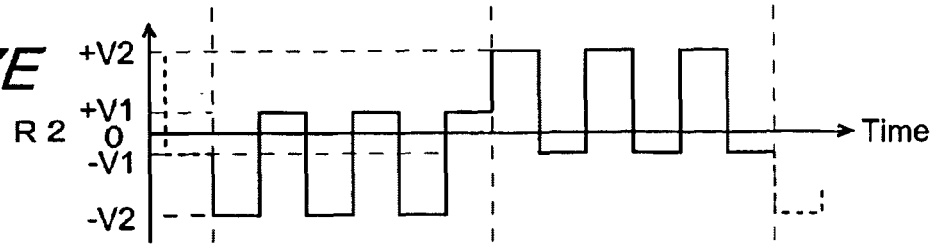

In this case, data signals G1, B1, R2 change as shown in FIGS. 7C, 7D and 7E, with respect to the baseline voltage provided by a voltage at the counter electrode Ec. Throughout FIGS. 7C–7E, symbols "S1"–"S6" indicate periods for which respective scanning signals SS1–SS6 become active, i.e. the horizontal scanning periods in a single frame. It should be noted here that in the modified staggered structure such as the one in FIGS. 7A and 7B, pixel data carried by data signals R1, B1, R2, B2 are not valid in the horizontal scanning period S1, and likewise, pixel data carried by data signals G1, G2 are not valid in the horizontal scanning period S6. For the sake of convenience, however, the description will assume that valid pixel data are carried by these data signals even in these periods S1 and S6. (This will also apply hereinafter.)

Now, attention will be paid to a pixel-forming portion (hereinafter called "pixel" for simplicity) in the first row of Column G1. This pixel is served by a feeding data line Lss, which holds a signal G1, and an adjacent data line Lsn holds a signal B1 (See FIG. 19C and FIGS. 7A and 7B). To this pixel, a data (−V2) is written in the horizontal scanning period in frame F1. Influence on the value of this pixel (the written value) by signal changes in the two data lines Lss, Lsn (direction and magnitude of the influence) depends on the amounts of signal change in the two data lines with respect to the baselines provided by a signal value in the feeding data line Lss and a signal value in the adjacent data line Lsn respectively at the time when the writing was made. Thus, with reference to FIGS. 7C–7E, the amounts of signal change in the two data lines in frame F1 will be obtained, with the baselines given by a value (−V2) of signal G1 in the feeding data line and by a value (−V1) of signal B1 in the adjacent data line. Next, attention will be turned to a pixel in the fifth row of Column G1, and the amounts of signal change in the two data lines in frame F2 (after the frame is switched) will be obtained, with the baselines given by a value (−V2) of signal G1 in the feeding data line and by a value (−V1) of signal B1 in the adjacent data line at the time when the writing was made. FIG. 8A shows these signal changes in frames F1 and F2 obtained as described above. (Not all data are shown.)

Next, attention will be paid to the borderline portion between the display unit for the color white and the display unit for the color black in the "checker back". Specifically, consideration will be made to the influence on the value of pixels in Column B1 caused by signal changes in the feeding data line and in the adjacent data line. For this purpose, attention is first made to a pixel in the first row of Column B1, and the amounts of signal change in the two data lines will be obtained, with the baselines provided by a value (+V2) of signal R2 in the feeding data line and by a value (+V1) of signal R2 in the adjacent data line at the time when the writing was made into this pixel (in the horizontal scanning period S2 in frame F1). Next, attention will be turned to the pixel in the fifth row of Column B1, and the amounts of signal change in the two data lines in frame F2 will be obtained, with the baselines given by a value (+V2) of signal B1 in the feeding data line and by a value (+V1) of signal R2 in the adjacent data line at the time when the writing was made into this pixel (in the horizontal scanning period S6 in frame F1). FIG. 8B shows these signal change in frames F1 and F2 obtained as described above. (Not all data are shown.)

Now, with reference to FIGS. 8A and 8B, attention will be paid to the pixel in Column G1 in frame F1 (before the frame is switched). This pixel (Column G1, Row 1) is influenced in such away that its value (−V2) is increased. On the other hand, when attention is paid to the pixel in Column B, the pixel (Column B1, Row 1) is influenced in such a way that its value (+V2) is decreased. As described, in Column G1 and Column B1, the pixels of attention have the same absolute value but with different signs (−V2 vs. +V2), and accordingly, their amounts of signal change also have different signs (+(V1+V2) vs. −(V1+V2)). However, the changes are equal to each other in the absolute value, and hence will cause the same influence on a displayed image. Likewise, in frame F2 (after the frame is switched), as will be clear from comparison between FIG. 8A and FIG. 8B, the pixel in Column G1 (Row 5) and the pixel in Column B1 (Row 5) have the absolute value but with different signs (−V2 vs. +V2), and accordingly, their amounts of signal change also have different signs (+(V1+V2) vs. −(V1+V2)). However, the changes are equal to each other in the absolute value, and hence will cause the same influence on a displayed image. On the other hand, signal changes in the feeding data line and the adjacent data line are "complementary" to each other for the pixel at Column G1, Row 5 in the horizontal scanning periods S2 and S4 in frame F2, as well as for the pixel at Column B1, Row 5 in the horizontal scanning periods S1 and S3 in frame F2, and thus influences on the pixel from the two data lines are canceled. Additionally, influence on the pixels in Row R1 is practically the same as the influence on the pixels in Column G1. Therefore, according to the present embodiment, it is possible to reduce the vertical shadow when the "checker back" is displayed.

<1.6. Advantages>

As has been described, according to the above embodiment, influences by signal changes in the feeding data line and the adjacent data line on the value of pixels when the "checker back" is displayed do not vary depending on the location of the pixels, and therefore the vertical shadow is reduced. Further, a quasi dot inversion driving method is achieved by using the column electrode driving circuit 300 which operates in the 1-H inversion driving method. Therefore, the column electrode driving circuit 300 can be implemented by using an IC having a low withstand voltage. Further, the column electrode driving circuit 300 delays image signals internally in accordance with the three-column-cycle staggered structure (see FIG. 3, FIGS. 4I–4K). Therefore, the column electrode driving circuit 300 can be supplied with the digital image signals Dr, Dg, Db in a conventional method, yet quality of display in the liquid crystal panel 500 of the three-column-cycle staggered structure is as high as in a standard liquid crystal panel which does not have a staggered structure.

<2. Second Embodiment>

Figure 24B:
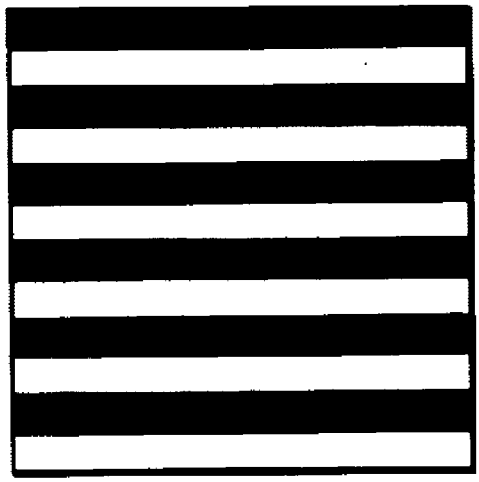
FIG. 24B shows the "horizontal stripe back" which is a pattern that causes the vertical shadow (killer pattern).

As described above, according to the first embodiment, the vertical shadow which accompanies the "checker back" is reduced. However, the vertical shadow appears when a horizontal stripe pattern called "horizontal stripe back" shown in FIG. 24B is displayed. A second embodiment of the present invention provides a liquid crystal display capable of reducing the vertical shadow which accompanies the "horizontal stripe back" as the above, as well. Here below, before describing the second embodiment, a basic study will be made about an appearance mechanism of the vertical shadow in the display of the "horizontal stripe back" in a liquid crystal panel having the three-column-cycle staggered structure and a liquid crystal panel having the common staggered structure (conventional zigzag structure). It should be noted that in describing the second embodiment, elements and components identical with those used in the first embodiment will be indicated by the same reference symbols and will not be described further.

<2.1. Basic Study>

<2.1.1. Three-Column-Cycle Staggered Structure>

Figure 9A:
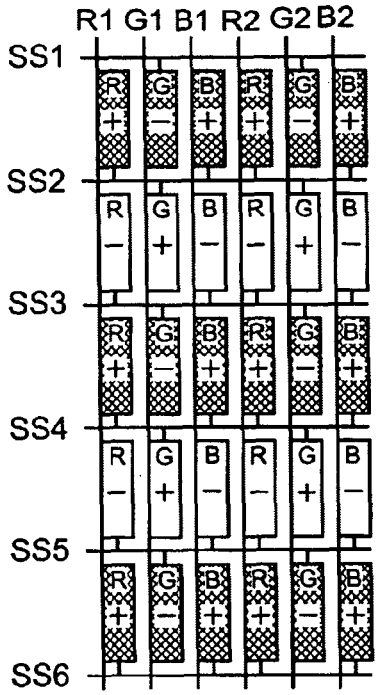
FIGS. 9A and 9B are schematic diagrams of a liquid crystal panel for a study if the vertical shadow appears when the "horizontal stripe back" is displayed by way of quasi dot inversion driving method based on a modified staggered structure of a three-column cycle.
Figure 9B:
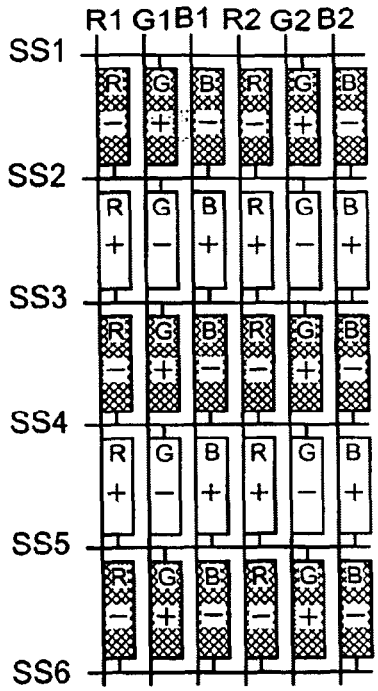

Again for convenience, the following study will use a liquid crystal panel of the three-column-cycle staggered structure including only 6×5 pixels served by five effective horizontal scanning lines and six data lines. (Note, however, that the number of scanning signal lines is six.) When displaying the "horizontal stripe back" in such a liquid crystal panel as the above, the "horizontal stripe back" is displayed under a polarity pattern as shown in FIG. 9A in one frame F1, and in the next frame F2, the "horizontal stripe back" is displayed under a polarity pattern as shown in FIG. 9B.

Figure 9C:
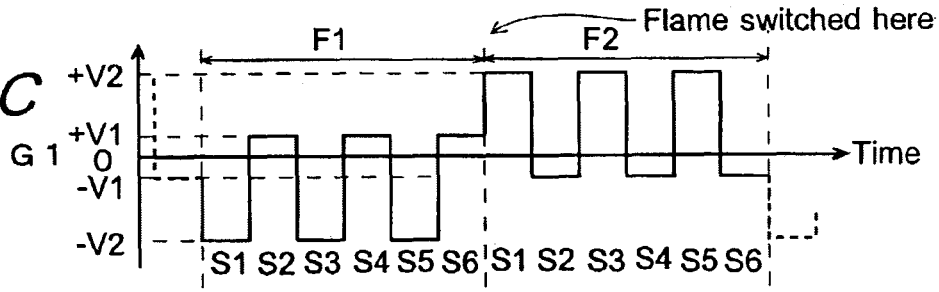
FIGS. 9C–9E show signal waveforms for a study if the vertical shadow appears when the "horizontal stripe back" is displayed by way of quasi dot inversion driving method based on the modified staggered structure of the three-column period.
Figure 9D:
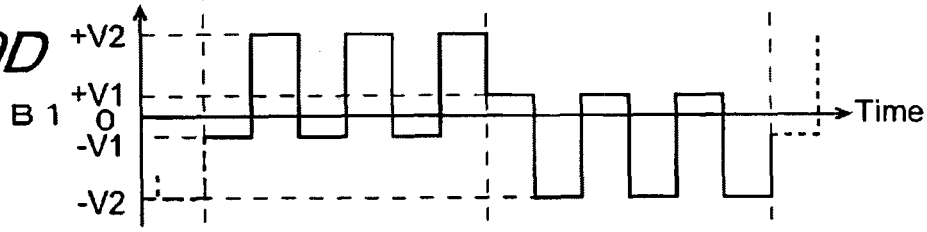
Figure 9E:
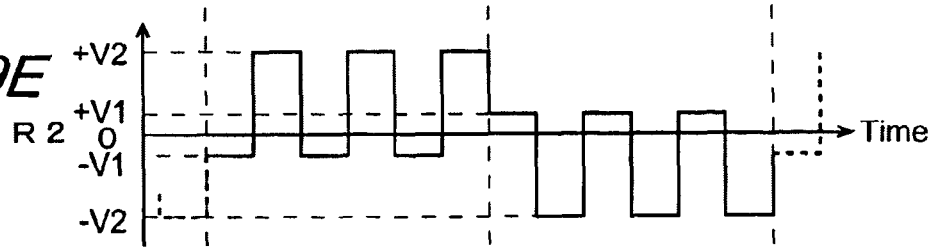

In this case, data signals G1, B1, R2 change as shown in FIGS. 9C, 9D and 9E, with respect to the baseline provided by a voltage at the counter electrode Ec. Hereinafter, with reference to FIGS. 9C, 9D and 9E, consideration will be made how signal changes in the feeding data line and the adjacent data line influence the value in each pixel.

First, consider influences on the pixels in Column G1 caused by signal changes in the feeding data line and the adjacent data line. For this purpose, attention is first made to a pixel in the first row of Column G1, and amounts of signal change in the two data lines will be obtained, with the baselines provided by a value (−V2) of signal G1 in the feeding data line and by a value (−V1) of signal B1 in the adjacent data line at the time when the writing was made into this pixel (in the horizontal scanning period S1 in frame F1). Next, attention will be paid to a pixel in the fifth row of Column G1, and amounts of signal change in the two data lines in frame F2 (after the frame is switched) will be obtained, with the baselines given by a value (−V2) of signal G1 in the feeding data line and by a value (−V1) of signal B1 in the adjacent data line at the time when the writing was made into this pixel (in the horizontal scanning period S5 in frame F1). FIG. 10A shows these amounts of signal change in frames F1 and F2 obtained as described above. (Not all data are shown.)

Next, attention will be paid to pixels in Column B1, to consider influences on pixel values caused by signal changes in the feeding data line and the adjacent data line. For this purpose, attention is first made to a pixel in the first row of Column B1, and amounts of signal change in the two data lines will be obtained, with the baselines provided by a value (+V2) of signal B1 in the feeding data line and by a value (+V2) of signal R2 in the adjacent data line at the time when the writing was made into this pixel (in the horizontal scanning period S2 in frame F1). Next, attention will be paid to a pixel in the fifth row of Column B1, and amounts of signal change in the two data lines in frame F2 will be obtained, with the baselines given by a value (+V2) of signal B1 in the feeding data line and by a value (+V2) of signal R2 in the adjacent data line at the time when the writing was made into this pixel (in the horizontal scanning period S6 in frame F1). FIG. 10B shows these amounts of signal change in frames F1 and F2 obtained as described above. (Not all data are shown.)

As understood from comparison between FIG. 10A and FIG. 10B, in frame F1 (before the frame is switched), the pixels of attention in Column G1 (Row 1) and in Column B1 (Row 1) have the same absolute value but with different signs (−V2 vs. +V2), and accordingly, their amounts of signal change also have different signs (+(V1+V2) vs. −(V1+V2)). However, the changes are equal to each other in the absolute value, and hence will cause the same influence on a displayed image. On the other hand, in frame F2 (after the frame is switched), it must be noted that the pixels of attention in Column G1 (Row 5) and in Column B1 (Row 5) have different values, and V2 is sufficiently greater than V1. This means the pixels are influenced differently by the feeding data line and the adjacent data line. Therefore, Column B1 that is influenced strongly by signal changes in the feeding data line and in the adjacent data line will show the vertical shadow.

<2.1.2. Common Staggered Structure>

Figure 11A:
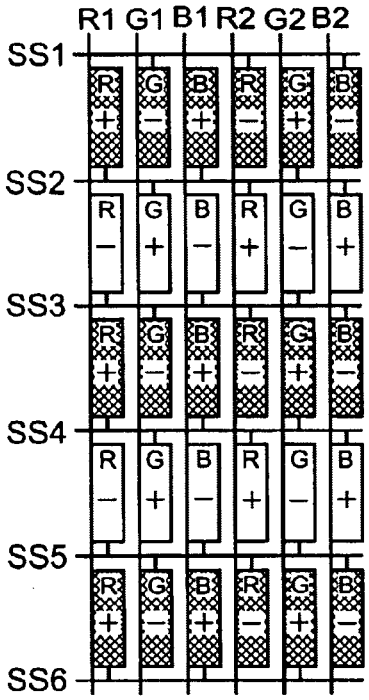
FIGS. 11A and 11B are schematic diagrams of a liquid crystal panel for a study if the vertical shadow appears when the "horizontal stripe back" is displayed by way of quasi dot inversion driving method based on a common staggered structure.
Figure 11B:
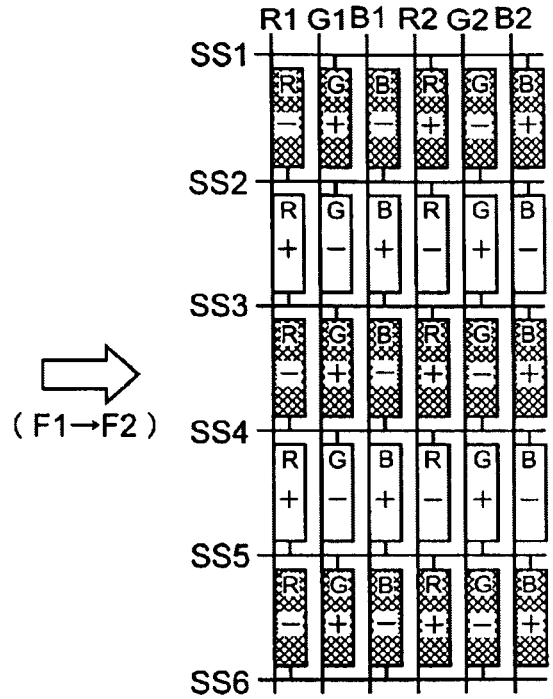

Next, assume a liquid crystal panel of a common staggered structure (the conventional staggered structure) including 6×5 pixels, with five effective horizontal scanning lines and six data lines (the number of scanning signal lines is six). When the "horizontal stripe back" is displayed in such a liquid crystal display as this, the "horizontal stripe back" is displayed under a polarity pattern as shown in FIG. 11A in one frame F1, and in the next frame F2, the "horizontal stripe back" is displayed under a polarity pattern as shown in FIG. 11B.

Figure 11C:
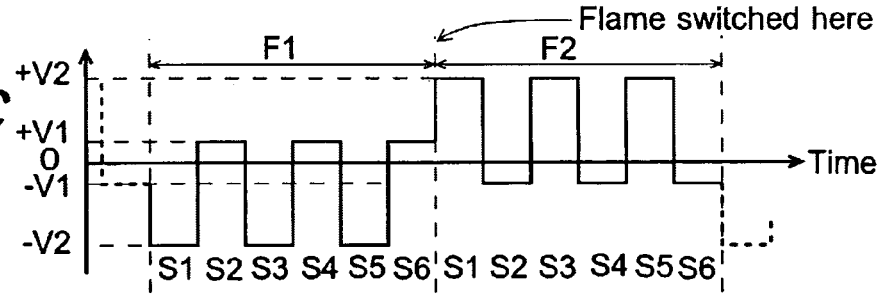
FIGS. 11C–11E show signal waveforms for a study if the vertical shadow appears when the "horizontal stripe back" is displayed by way of quasi dot inversion driving method based on the common staggered structure.
Figure 11D:
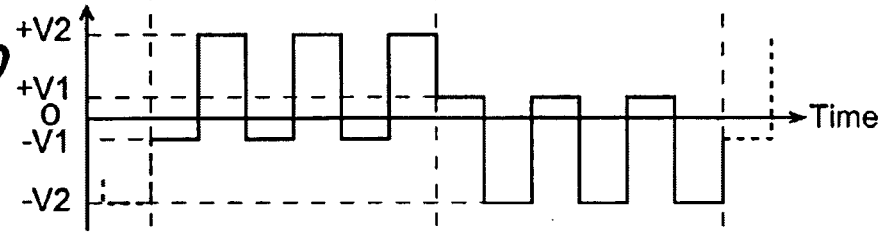
Figure 11E:
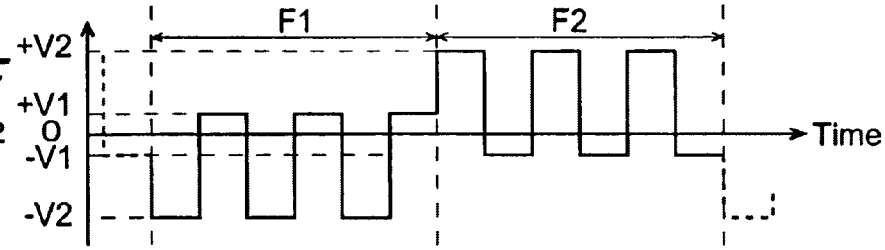

In this case, data signals G1, B1, R2 change as shown in FIGS. 11C, 11D and 11E respectively, with respect to the baseline provided by an electric potential of the counter electrode Ec. Here below, with reference to FIGS. 11C, 11D and 11E, consideration will be made on how pixels of attention will be influenced by signal changes in the feeding data line and the adjacent data line.

First, consider influences on the pixels in Column G1 caused by signal changes in the feeding data line and the adjacent data line. For this purpose, attention is first made to a pixel in the first row of Column G1, and amounts of signal change in the two data lines will be obtained, with the baselines provided by a value (−V2) of signal G1 in the feeding data line and by a value (−V1) of signal B1 in the adjacent data line at the time when the writing was made into this pixel (in the horizontal scanning period S1 in frame F1). Next, attention will be paid to a pixel in the fifth row of Column G1, and amounts of signal change in the two data lines in frame F2 (after the frame is switched) will be obtained, with the baselines given by a value (−V2) of signal G1 in the feeding data line and by a value (−V1) of signal B1 in the adjacent data line at the time when the writing was made into this pixel (in the horizontal scanning period S5 in frame F1). FIG. 12A shows these amounts of signal change in frames F1 and F2 obtained as described above. (Not all data are shown.)

Next, attention will be paid to pixels in Column B1, to consider influences on pixel values caused by signal changes in the feeding data line and the adjacent data line. For this purpose, attention is first made to a pixel in the first row of Column B1, and amounts of signal change in the two data lines will be obtained, with the baselines provided by a value (+V2) of signal B1 in the feeding data line and by a value (+V1) of signal R2 in the adjacent data line at the time when the writing was made into this pixel (in the horizontal scanning period S2 in frame F1). Next, attention will be paid to a pixel in the fifth row of Column B1, and amounts of signal change in the two data lines in frame F2 will be obtained, with the baselines given by a value (+V2) of signal B1 in the feeding data line and by a value (+V1) of signal R2 in the adjacent data line at the time when the writing was made into this pixel (in the horizontal scanning period S6 in frame F1). FIG. 12B shows these amounts of signal change in frames F1 and F2 obtained as described above. (Not all data are shown.)

As understood from comparison between FIG. 12A and FIG. 12B, in frame F1 (before the frame is switched), the pixels of attention in Column G1 (Row 1) and in Column B1 (Row 1) have the same absolute value but with different signs (−V2 vs. +V2), and accordingly, their amounts of signal change also have different signs (+(V1+V2) vs. −(V1+V2)). However, the changes are equal to each other in the absolute value, and hence will cause the same influence on a displayed image. Likewise, in frame F2 (after the frame is switched), the pixels of attention in Column G1 (Row 5) and in Column B1 (Row 5) have the same absolute value but with different signs (−V2 vs. +V2) and accordingly, their amounts of signal change also have different signs (+2V2 and −2V2 vs. +2V1 and −2V1). However, the changes are equal to each other in the absolute value, and hence will cause the same influence on a displayed image. Further, signal changes in the feeding data line and the adjacent data line are "complementary" to each other for the pixel at Column G1, Row 5 in the horizontal scanning periods S2 and S4 in frame F2, as well as for the pixel at Column B1, Row 5 in the horizontal scanning periods S1 and S3 in frame F2, and thus influences on the pixel from the two data lines are canceled. Additionally, influence on the pixels in Row R1 is practically the same as the influence on the pixels in Column G1. Therefore, according to the common staggered structure, the vertical shadow does not appear when the "horizontal stripe back" is displayed.

<2.2. Structure of Liquid Crystal Panel>

Figure 13A:
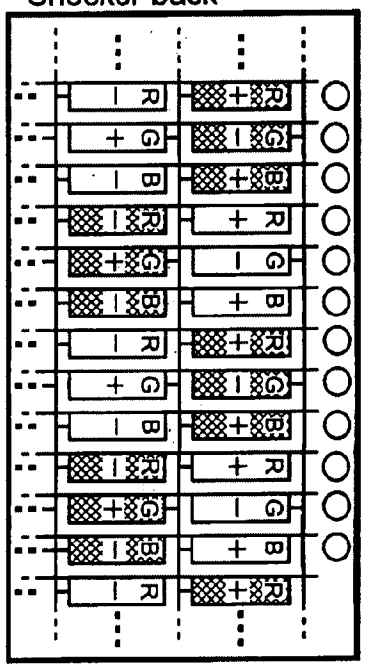
FIG. 13A shows if the vertical shadow appears when the "checker back" is displayed in a liquid crystal panel having a modified staggered structure of a three-column period.
Figure 13B:
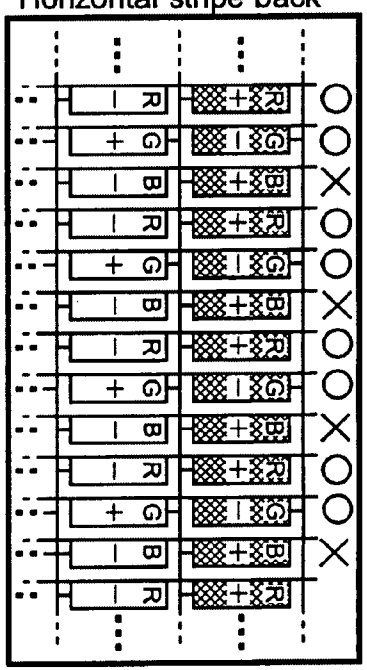
FIG. 13B shows if the vertical shadow appears when the "horizontal stripe back" is displayed in a liquid crystal panel having the modified staggered structure of the three-column period.
Figure 13C:
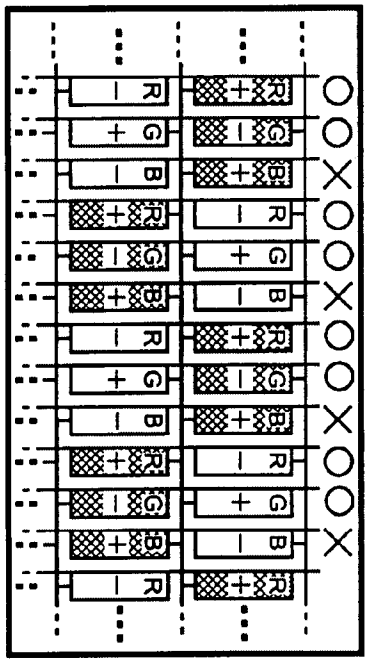
FIG. 13C shows if the vertical shadow appears when the "checker back" is displayed in a liquid crystal panel having a common staggered structure.
Figure 13D:
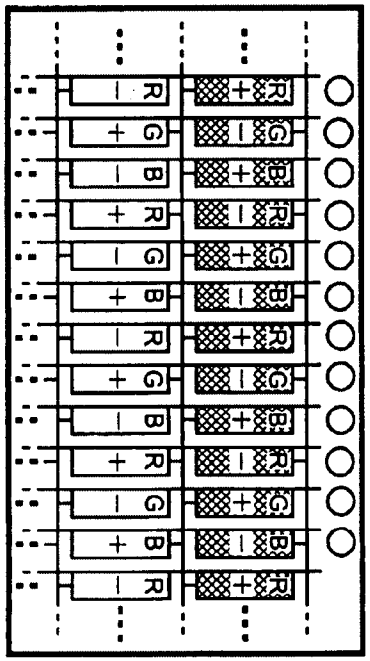
FIG. 13D shows if the vertical shadow appears when the "horizontal stripe back" is displayed in a liquid crystal panel having the common staggered structure.

As described earlier, when the "checker back" is displayed in a liquid crystal panel of the three-column-cycle staggered structure, the vertical shadow does not appear, but it appears in a display panel of the common staggered structure. On the other hand, as has been known from the above basic study, when the "horizontal stripe back" is displayed in a liquid crystal panel of the three-column-cycle staggered structure, the vertical shadow appears, but it does not appear in a display panel of the common staggered structure. FIGS. 13A–13D summarize these relationships between the structure of the liquid crystal panel and display of the two killer patterns, i.e. "checker back" and "horizontal stripe back". FIGS. 13A, 13B, 13C and 13D show whether or not the vertical shadow appears when: the "checker back" is displayed in the liquid crystal panel of the three-column-cycle staggered structure; the "horizontal stripe back" is displayed in the liquid crystal panel of the three-column-cycle staggered structure; the "checker back" is displayed in the liquid crystal panel of the common staggered structure; and the "horizontal stripe back" is displayed in the liquid crystal panel of the common staggered structure. In these figures, the circle symbol "O" means that the column of the pixels right below does not show the vertical shadow whereas the X symbol "X" means that the column of the pixels right below shows the vertical shadow. As shown in FIGS. 13A and 13B, a liquid crystal panel of the three-column-cycle staggered structure reduces the vertical shadow when displaying the "checker back", but allows the vertical shadow to appear when displaying the "horizontal stripe back", at a rate of four pixel columns per 12 pixel columns (1 pixel column per three pixel columns). On the other hand, as shown in FIGS. 13C and 13D, the common staggered structure reduces the vertical shadow when displaying the "horizontal stripe back", but allows the vertical shadow when displaying the "checker back", at a rate of four pixel columns per 12 pixel columns (1 pixel column per three pixel columns).

Figure 14A:
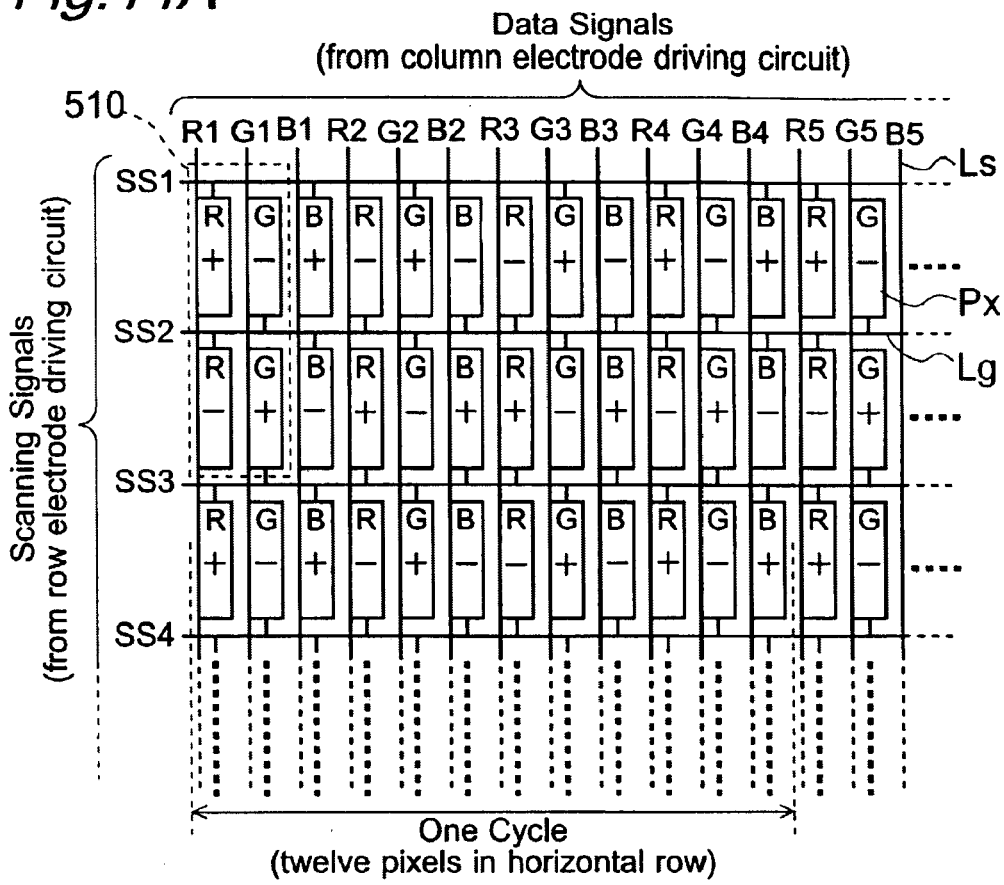
FIGS. 14A and 14B are schematic diagrams of a liquid crystal panel in a liquid crystal display according to a second embodiment of the present invention.
Figure 14B:
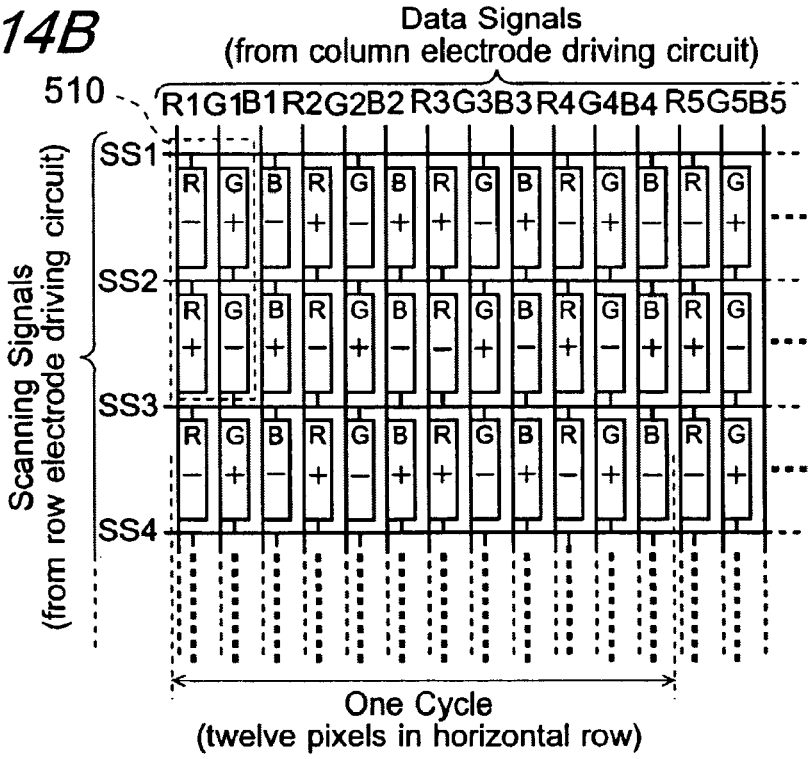

Thus, according to the present embodiment, in order to reduce the vertical shadow in both cases of displaying the "checker back" and displaying the "horizontal stripe back", a new staggered structure is used as shown in FIGS. 14A and 14B, that takes advantages of the three-column-cycle staggered structure and those of the common staggered structure. The liquid crystal panel of a structure as the above has a similar construction as in the first embodiment (FIGS. 2A and 2B). Specifically, rows of the pixel electrodes and the data lines Ls are alternated with each other in the horizontal direction whereas rows of the pixel electrodes and the scanning signal lines Lg are alternated with each other in the vertical direction. Further, three pixels formed by the pixel-forming portions Px and adjacent in the horizontal direction for respective colors of red (R), green (G) and blue (B) serve as a unit of display. Still further, those pixel electrodes connected to the TFTs turned on and off by the same scanning signal line Lg are located dispersedly in two adjacent pixel rows. Therefore, this structure can also be regarded as a staggered structure.

However, according to this liquid crystal panel, the pixel electrodes Ep connected to the TFTs turned on and off by the same scanning signal line Lg are located in two pixel rows which are mutually adjacent in a vertical relationship, in a horizontally periodical pattern having a cycle of "down, up, down, up, down, up, up, down, up, down, up, down" as to which of the up row and the down row is selected in the assignment of twelve pixel electrodes. (Hereinafter, such a structure as this will be called "twelve-column-cycle staggered structure".) In this regard, the structure of this liquid crystal panel is different from the structure of the liquid crystal panel according to the first embodiment or the three-column-cycle staggered structure (FIG. 2A). It should be noted that according to the example shown in FIGS. 14A and 14B, the pixel electrodes Ep connected to the TFTs turned on and off by the same scanning signal line Lg are located in an up-and-down staggered pattern (in an up row or a down row of two mutually adjacent pixel rows), in the horizontal cycle of "down, up, down, up, down, up, up, down, up, down, up, down". However, "up" and "down" may be swapped each other, to make another horizontal pattern "up, down, up, down, up, down, down, up, down, up, down, up".

When a liquid crystal panel having the twelve-column-cycle staggered structure is driven by a column electrode driving circuit built for the 1-H inversion driving, display is made under a polarity pattern as shown in FIG. 14A in one frame whereas in the next frame, display is made under a polarity pattern as shown in FIG. 14B, achieving a quasi dot inversion driving method. In FIGS. 14A and 14B, a plus sign "+" accompanying a pixel-forming portion Px indicates that a positive electric voltage is applied to the pixel liquid-crystal (or the pixel electrode) in the pixel-forming portion Px. Likewise, a minus sign "−" indicates that a negative electric voltage is applied to the pixel liquid-crystal (or pixel electrode) in the pixel-forming portions Px.

Figure 15A:
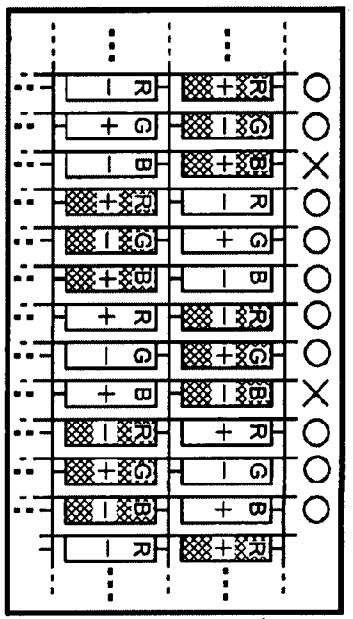
FIG. 15A shows if the vertical shadow appears when the "checker back" is displayed in the second embodiment.
Figure 15B:
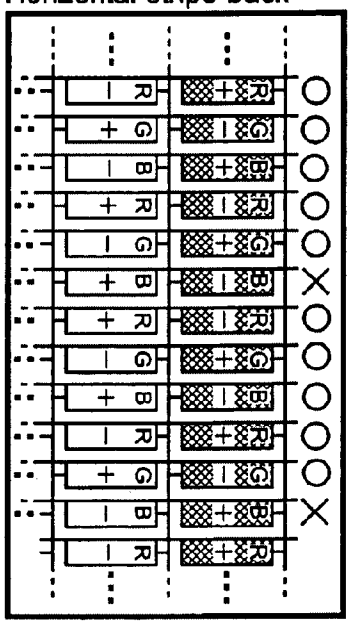
FIG. 15B shows if the vertical shadow appears when the "horizontal stripe back" is displayed in the second embodiment.

When the "checker back" is displayed in a liquid crystal panel of the twelve-column-cycle staggered structure, the vertical shadow will appear as shown in FIG. 15A as understood from FIGS. 13A–13C. Likewise, when the "horizontal stripe back" is displayed in a liquid crystal panel of the twelve-column-cycle staggered structure, the vertical shadow will appear as shown in FIG. 15B as understood from FIGS. 13B and 13D. In these figures, the circle symbol "O" means that the column of the pixels right below does not show the vertical shadow whereas the X symbol "X" means that the column of the pixels right below shows the vertical shadow. As understood from these FIGS. 15A and 15B, according to a liquid crystal panel of the twelve-column-cycle staggered structure, in both cases of displaying the "checker back" and displaying the "horizontal stripe back", the vertical shadow appears only at a rate of two pixel columns per twelve pixel columns (one pixel column per six pixel columns). Thus, a drastic reduction has been achieved over the case of displaying the "checker back" in a liquid crystal panel of the common staggered structure (FIG. 13C) and over the case of displaying the "horizontal stripe back" in a liquid crystal panel of the three-column-cycle staggered structure (FIG. 13B).

<2.3. Column Electrode Driving Circuit>

Figure 16:
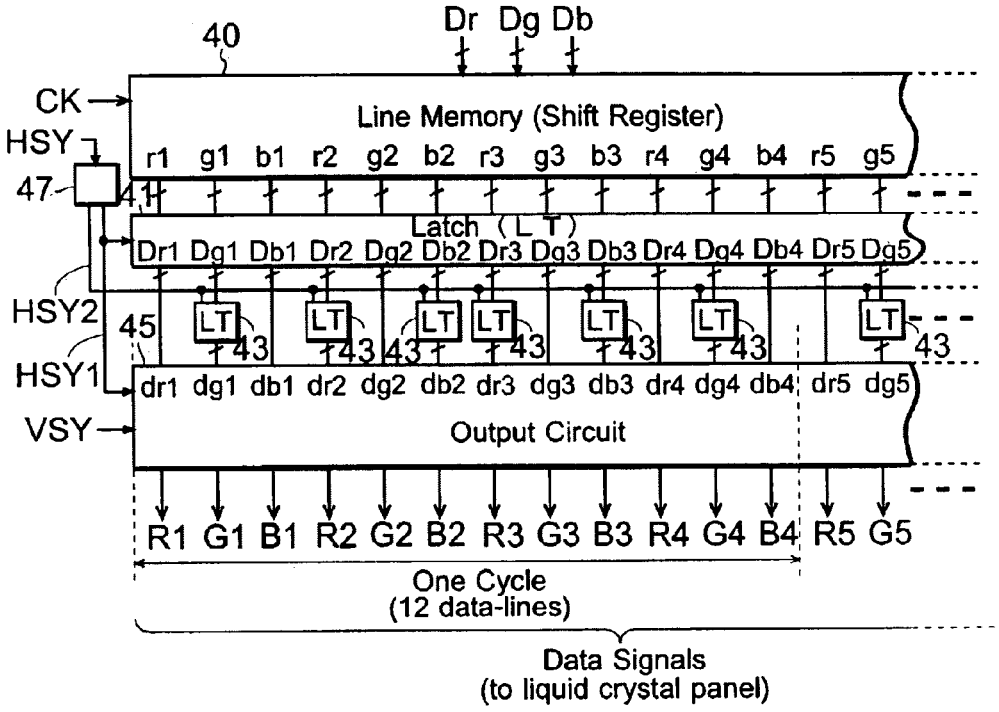
FIG. 16 is a block diagram of a column electrode driving circuit according to the second embodiment.

FIG. 16 is a block diagram of a column electrode driving circuit according to the present embodiment, i.e. a column electrode driving circuit having an arrangement necessary for driving the liquid crystal panel of the twelve-column-cycle staggered structure. This column electrode driving circuit can output data signals Rj, Gj, Bj (j=1, 2, 3, . . . ) to appropriate pixels, at a timing appropriate to the above twelve-column-cycle staggered structure, i.e. at a specific timing for the simultaneously-selected pixel electrodes assigned in a dispersed pattern to two mutually adjacent pixel lines as shown in FIGS. 14A and 14B. In the following description of this column electrode driving circuit, elements and components identical with those used in the column electrode driving circuit 300 of the first embodiment will be indicated by the same reference symbols and will not be described further.

In the column electrode driving circuit according to the present embodiment, the latch circuit 41 serving as the holding means or the holding circuit outputs the second internal image signals Drj, Dgj, Dbj (j=1, 2, 3, . . . ), which are then selectively delayed by a single cycle of the horizontal scanning period by the delaying means or the delaying circuit provided by a latch circuit disposed at a different location from the location in the first embodiment. Thus, for clarification from the latch circuit 42 according to the first embodiment, the latch circuit serving as the delaying means or the delaying circuit according to the present embodiment is indicated by a reference numeral "43". According to the present embodiment, when the latch circuit 41 serving as the holding means or the holding circuit outputs the second internal image signals Drj, Dgj, Dbj, those signals for Columns G1, R2, B2, R3, B3, G4, G5, . . . are inputted to the output circuit 45 via the latch circuit 43 serving as the delay means or the delay circuit whereas the other internal image signals are inputted directly to the output circuit 45. The latch circuit 43 works on the bases of the second gate signal HSY2 shown in FIG. 4B, and delays the second internal image signals Dg1, Dr2, Db2, Dr3, Db3, Dg4, Dg5 . . . for Columns G1, R2, B2, R3, B3, G4, G5, . . . by a single cycle of the horizontal scanning period. Thus, according to the liquid crystal panel shown in FIGS. 14A and 14B in which each of the pixel-forming portions Px (the pixel electrodes) is sandwiched by an upper and a lower scanning signal lines Lg, and a group of the pixel-forming portions have the gate terminals of their respective TFTs 10 connected to the lower scanning signal line, pixel values carried in the second internal image signals Dg1, Dr2, Db2, Dr3, Db3, Dg4, Dg5, . . . for the pixel-forming portions that include these TFTs 10 are delayed for a cycle of the horizontal scanning period, and inputted as the third internal image signals dg1, dr2, db2, dr3, db3, dg4, dg5, . . . to the output circuit 45 (FIG. 4J).

According to a column electrode driving circuit such as the above, it is possible to delay image signals within the column electrode driving circuit, in accordance with the twelve-column-cycle staggered structure.

<2.4. Advantages>

As has been described, according to the above embodiment, the vertical shadow is not completely eliminated when displaying the "checker back" or the "horizontal stripe back", but drastically reduced (FIGS. 15A and 15B) over the case in which the "horizontal strip back" is displayed in a liquid crystal display of the three-column-cycle staggered structure (FIG. 13B), and the case in which the "checker back" is displayed in a liquid crystal panel of the common staggered structure (FIG. 13C). Further, a quasi dot inversion driving method is achieved by using a column electrode driving circuit operating in the 1-H inversion driving method. Therefore, the column electrode driving circuit can be built by using an IC having a low withstand voltage. Further, the column electrode driving circuit delays image signals internally in accordance with the twelve-column-cycle staggered structure (see FIG. 16). Therefore, the column electrode driving circuit can be supplied with the digital image signals Dr, Dg, Db in a conventional method, yet quality of display in the liquid crystal panel of the twelve-column-cycle staggered structure is as high as in a standard liquid crystal panel which does not have a staggered structure.

<3. Variation>

Figures 17A, 17B, 17C, 17D, 17E, 17F, 17G, 17H, 17I, 17J:
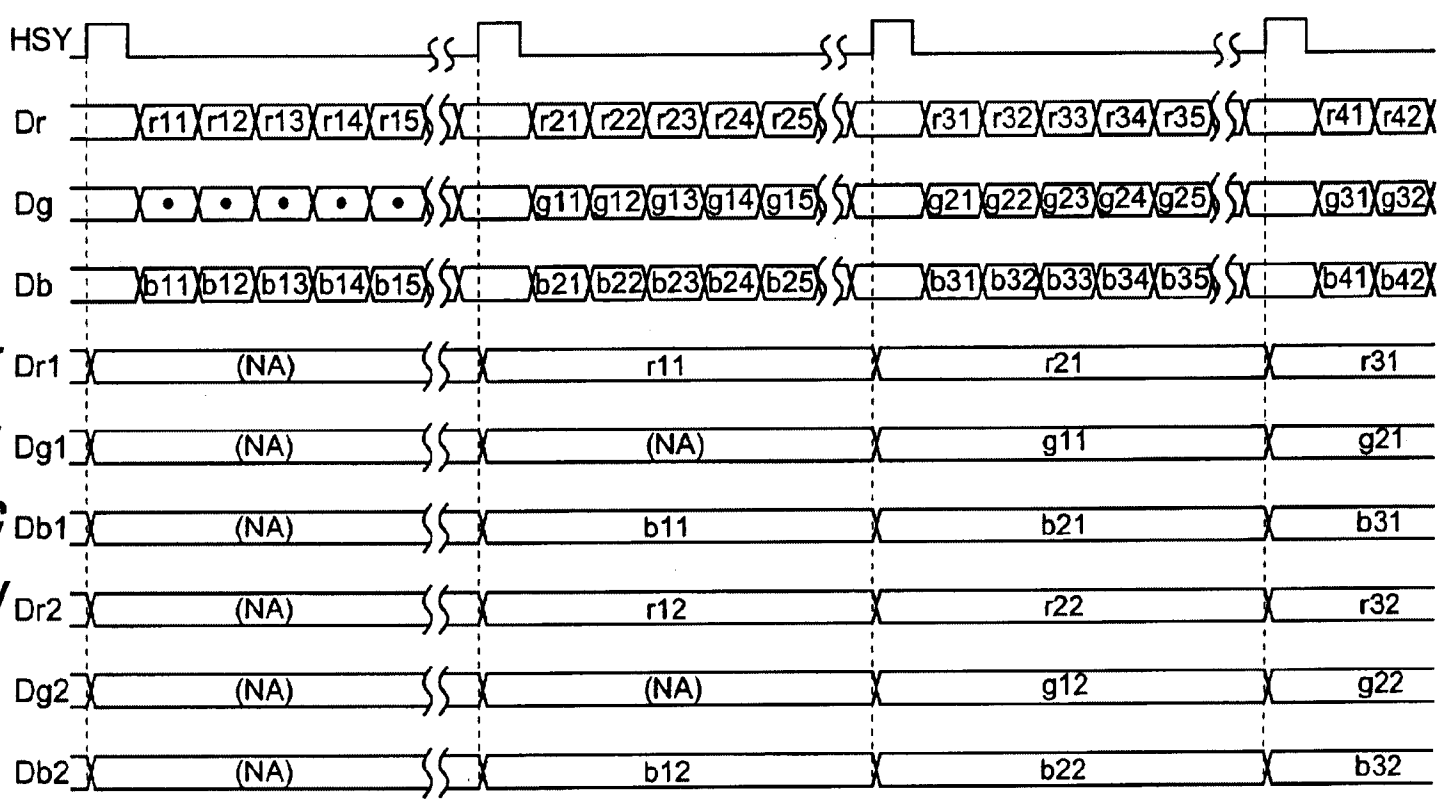
FIGS. 17A–17J are timing charts showing an operation of a display controlling circuit according to a variation of the first embodiment.

As described, in a liquid crystal panel which uses a staggered structure, the simultaneously-selected pixel electrodes are assigned to two mutually adjacent pixel rows. Therefore, the column electrode driving circuit must output data signals in accordance with a given pattern of the staggered structure. In order to achieve this, the column electrode driving circuit according to the first embodiment includes the latch circuit 42 (FIG. 3) as means for selectively delaying internal signals in accordance with the three-column-cycle staggered structure. Likewise, the column electrode driving circuit according to the second embodiment includes the latch circuit 43 (FIG. 16) as means for selectively delaying internal signals in accordance with the twelve-column-cycle staggered structure. However, as an alternative to the timing adjustment within the column electrode driving circuit as described above, pixel data of the image to be displayed may be modified in accordance with the given staggered structure, and such modified digital image signals Dr, Dg, Db may be supplied to the column electrode driving circuit. For example, as shown in FIG. 2A, for a liquid crystal panel of the three-column-cycle staggered structure, the modification should be made so that pixel data of the image are supplied in the order shown in FIG. 17B–17D, from the display controlling circuit to the column electrode driving circuit, in the form of the digital image signals Dr, Dg, Db. In order to achieve this, external control can be provided from outside of the liquid crystal display, on the writing of the image data into the display memory in the display control circuit and/or reading of the image therefrom, so that pixel data are outputted as the digital image signals Dr, Dg, Db from the display controlling circuit in the order shown in FIGS. 17B–17D. Note that in FIGS. 17A–17J, reference symbols "rij" "gij" and "bij" indicate pixel data representing a red color component, a green color component and a blue color component respectively in the j-th block in the i-th line.

Figure 18:
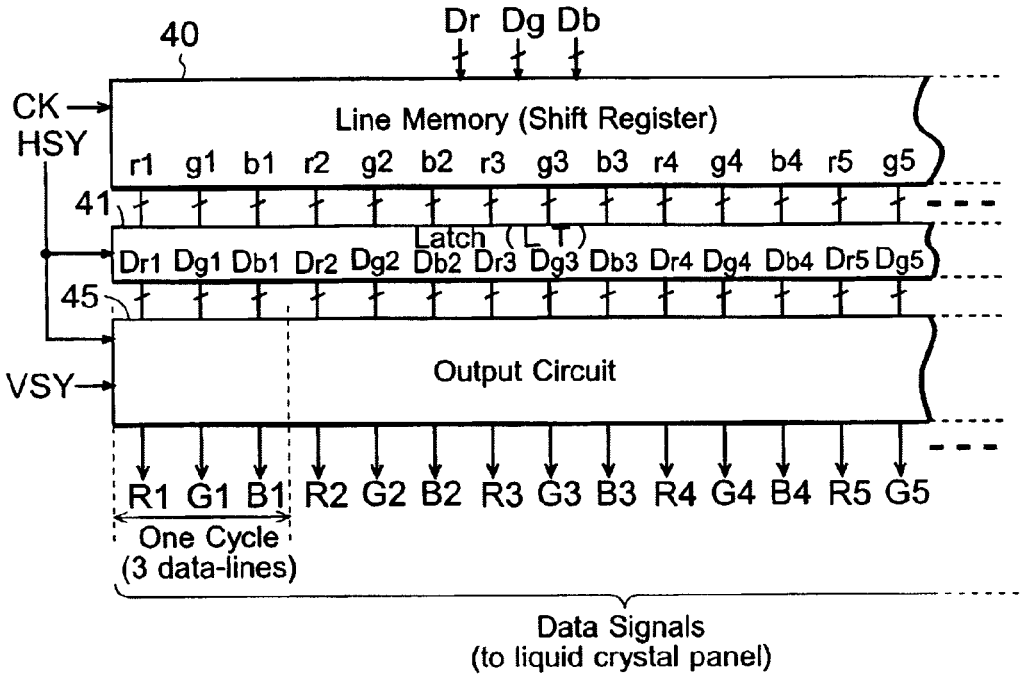
FIG. 18 is a block diagram of a column electrode driving circuit according to the variation.

The display controlling circuit having such an arrangement as described eliminates the need for the timing adjustment within the column electrode driving circuit in accordance with the staggered structure of the liquid crystal panel, and therefore can use a common column electrode driving circuit built for the conventional 1-H inversion driving such as shown in FIG. 18. Note that in FIG. 18, those parts and components identical with those of the column electrode driving circuit 300 (FIG. 3) in the first embodiment are indicated by the same reference symbols. According to the column electrode driving circuit in FIG. 18, the second internal image signals Drj, Dgj, Dbj (j=1, 2, 3, . . . ) which are held by the latch circuit 41 for a single cycle of the horizontal scanning period based on the horizontal synchronizing signal HSY (FIG. 17A) are timed as shown in FIGS. 17E–17J to the three-column-cycle staggered structure, and therefore, fed directly to the output circuit 45 without the need for the delaying means (delaying circuit).

As understood, a display controlling circuit such as the above eliminates the need for the timing adjustment within the column electrode driving circuit in accordance with a given staggered structure of the liquid crystal panel. Thus, a column electrode driving circuit of the conventional 1-H inversion driving method can be used advantageously to achieve a quality of display as high as in a liquid crystal panel of a common, non-staggered, structure.

While the invention has been described in detail, the foregoing description is in all aspects illustrative and not restrictive. It is understood that numerous other modifications and variations can be devised without departing from the scope of the invention.

The present application is an application claiming priority based on the Japanese Patent Application No. 2001-378031 filed on Dec. 12, 2001, under the title of "Liquid Crystal Display", the contents of which are herein incorporated by reference

What is claimed is:

1. A liquid crystal display for displaying a color image, comprising:

a plurality of data signal lines;

a plurality of scanning signal lines intersecting the data signal lines; and a plurality of pixel-forming portions each related to one of the intersections made by the data signal lines and the scanning lines, and disposed in a matrix pattern;

each of the pixel-forming portions including:

a switching element turned on and off by the scanning signal line passing the related intersection and serving as a feeding scanning signal line;

a pixel electrode connected via the switching element to the data signal line passing the related intersection and serving as a feeding data signal line;

a counter electrode common to the pixel-forming portions for holding predetermined capacities between the counter electrode and the pixel electrodes; and a liquid crystal layer common to the pixel-forming portions, sandwiched between the pixel electrodes and the counter electrode;

wherein, simultaneously-selected pixel electrodes that are a group of the pixel electrodes each connected to one of the switching elements turned on and off by a same scanning signal line, are assigned dispersedly to two mutually adjacent up and down rows of the matrix of pixel-forming portions, and in a horizontally periodical pattern having a cycle of "up, down, up" or "down, up, down" as to which of the up row and the down row is selected in the assignment of three pixel electrodes.

2. The liquid crystal display according to claim 1, further comprising:

an output circuit outputting and thereby feeding the data signal lines with data signals for displaying the color image so that a polarity of voltage applied to the pixel electrode is the same for the simultaneously-selected pixel electrodes and is altered for each horizontal scanning period; and a delaying circuit selectively delaying the feeding of the data signal to the data signal lines feeding the pixel-forming portions including the simultaneously-selected pixel electrodes assigned to the up row of the two rows, by a single cycle of the horizontal scanning period.

3. A liquid crystal display for displaying a color image, comprising:

a plurality of data signal lines;

a plurality of scanning signal lines intersecting the data signal lines; and a plurality of pixel-forming portions each related to one of the intersections made by the data signal lines and the scanning lines, and disposed in a matrix pattern;

each of the pixel-forming portions including:

a switching element turned on and off by the scanning signal line passing the related intersection and serving as a feeding scanning signal line;

a pixel electrode connected via the switching element to the data signal line passing the related intersection and serving as a feeding data signal line;

a counter electrode common to the pixel-forming portions for holding predetermined capacities between the counter electrode and the pixel electrodes; and a liquid crystal layer common to the pixel-forming portions, sandwiched between the pixel electrodes and the counter electrode;

wherein simultaneously-selected pixel electrodes that are a group of the pixel electrodes each connected to one of the switching elements turned on and off by a same scanning signal line, are assigned dispersedly to two mutually adjacent up and down rows of the matrix of pixel-forming portions, and in a horizontally periodical pattern having a cycle of "up, down, up, down, up, down, down, up, down, up, down, up" or "down, up, down, up, down, up, up, down, up, down, up, down" as to which of the up row and the down row is selected in the assignment of twelve pixel electrodes.

4. The liquid crystal display according to claim 3, further comprising:

an output circuit outputting and thereby feeding the data signal lines with data signals for displaying the color image so that a polarity of voltage applied to the pixel electrode is the same for the simultaneously-selected pixel electrodes and is altered for each horizontal scanning period; and a delaying circuit selectively delaying the feeding of the data signal to the data signal lines feeding the pixel-forming portions including the simultaneously-selected pixel electrodes assigned to the up row of the two rows, by a single cycle of the horizontal scanning period.

5. A column electrode driving circuit supplying data signals for displaying an image in a liquid crystal panel including: a plurality of data signal lines; a plurality of scanning signal lines intersecting the data signal lines; and a plurality of pixel-forming portions each related to one of the intersections made by the data signal lines and the scanning lines, and disposed in a matrix pattern; simultaneously-selected pixel electrodes that are a group of the pixel electrodes included in the pixel-forming portions driven by a same scanning signal line, being assigned dispersedly to two mutually adjacent up and down rows of the matrix of pixel-forming portions; the column electrode driving circuit comprising:

an output circuit outputting and thereby feeding the data signal lines with the data signals so that a polarity of voltage applied to the pixel electrode is the same for the simultaneously-selected pixel electrodes and is altered for each horizontal scanning period; and a delaying circuit delaying the feeding of the data signal to part of the plurality of data signal lines;

wherein the simultaneously-selected pixel electrodes are assigned dispersedly to two mutually adjacent up and down rows of the matrix of pixel-forming portions, and in a horizontally periodical pattern having a cycle of "up, down, up" or "down, up, down" as to which of the up row and down row is selected in the assignment of three pixel electrodes;

the delaying circuit delaying the feeding of the signal to the data signal lines feeding the pixel-forming portions including the simultaneously-selected pixel electrodes assigned to the up row of the two rows, by a single cycle of the horizontal scanning period.

6. The column electrode driving circuit according to claim 5, further comprising a holding circuit holding image data of an image to be displayed in the liquid crystal panel, sequentially, line by line, for a single cycle of the horizontal scanning period, and outputting an internal image signal carrying the line of the image data held within;

wherein the output circuit outputs the data signals based on the internal image signal so that a polarity of voltage applied to the pixel electrode is the same for the simultaneously-selected pixel electrodes and is altered for each horizontal scanning period;

the delaying circuit being placed between the holding circuit and the outputting circuit, and selectively delaying the internal image signal for the output of the data signal from the output circuit to the data signal lines related to the pixel-forming portions including the simultaneously-selected pixel electrodes assigned to the up row of the two rows, by a single cycle of the horizontal scanning period.

7. A method of driving a liquid crystal panel, based on color image data, the liquid crystal panel including: a plurality of data signal lines; a plurality of scanning signal lines intersecting the data signal lines; and a plurality of pixel-forming portions each related to one of the intersections made by the data signal lines and the scanning lines, and disposed in a matrix pattern; simultaneously-selected pixel electrodes that are a group of the pixel electrodes included in the pixel-forming portions driven by a same scanning signal line, being assigned dispersedly to two mutually adjacent up and down rows of the matrix of pixel-forming portions; the method comprising:

a scan driving step of feeding the scanning signal lines with scanning signals for alternate and sequential selection of one from the scanning signal lines for each horizontal scanning period;

a data driving step of feeding the data signal lines with data signals for displaying an image represented by the color image data so that a polarity of voltage applied to the pixel electrode is the same for the simultaneously-selected pixel electrodes and is altered for each horizontal scanning period; and a selection delaying step of selectively delaying the feeding of the data signal to the data signal lines feeding the pixel-forming portions including the simultaneously-selected pixel electrodes assigned to the up row of the two rows, by a single cycle of the horizontal scanning period;

wherein the pixel-forming portions having their respective pixel electrodes assigned dispersedly to two mutually adjacent up and down rows of the matrix of pixel-forming portions and in a horizontally periodical pattern having a cycle of "up, down, up" or "down, up, down" as to which of the up row and the down row is selected in the assignment of three pixel electrodes are driven by a same scanning signal line in the scan driving step.

8. A method of driving a liquid crystal panel, based on color image data, the liquid crystal panel including: a plurality of data signal lines; a plurality of scanning signal lines intersecting the data signal lines; and a plurality of pixel-forming portions each related to one of the intersections made by the data signal lines and the scanning lines, and disposed in a matrix pattern; simultaneously-selected pixel electrodes that are a group of the pixel electrodes included in the pixel-forming portions driven by a same scanning signal line, being assigned dispersedly to two mutually adjacent up and down rows of the matrix of pixel-forming portions; the method comprising:

a scan driving step of feeding the scanning signal lines with scanning signals for alternate and sequential selection of one from the scanning signal lines for each horizontal scanning period;

a data driving step of feeding the data signal lines with data signals for displaying an image represented by the color image data so that a polarity of voltage applied to the pixel electrode is the same for the simultaneously-selected pixel electrodes and is altered for each horizontal scanning period; and a selection delaying step of selectively delaying the feeding of the data signal to the data signal lines feeding the pixel-forming portions including the simultaneously-selected pixel electrodes assigned to the up row of the two rows, by a single cycle of the horizontal scanning period;

wherein the pixel-forming portions having their respective pixel electrodes assigned dispersedly to two mutually adjacent up and down rows of the matrix of pixel-forming portions and in a horizontally periodical pattern having a cycle of "up, down, up, down, up, down, down, up, down, up, down, up" or "down, up, down, up, down, up, up, down, up, down, up, down" as to which of the up row and the down row is selected in the assignment of twelve pixel electrodes are driven by a same scanning signal line in the scan driving step.

9. A column electrode driving circuit supplying data signals for displaying an image in a liquid crystal panel including: a plurality of data signal lines; a plurality of scanning signal lines intersecting the data signal lines; and a plurality of pixel-forming portions each related to one of the intersections made by the data signal lines and the scanning lines, and disposed in a matrix pattern; simultaneously-selected pixel electrodes that are a group of the pixel electrodes included in the pixel-forming portions driven by a same scanning signal line, being assigned dispersedly to two mutually adjacent up and down rows of the matrix of pixel-forming portions; the column electrode driving circuit comprising:

an output circuit outputting and thereby feeding the data signal lines with the data signals so that a polarity of voltage applied to the pixel electrode is the same for the simultaneously-selected pixel electrodes and is altered for each horizontal scanning period; and a delaying circuit delaying the feeding of the data signal to part of the plurality of data signal lines;

wherein the simultaneously-selected pixel electrodes are assigned dispersedly to two mutually adjacent up and down rows of the matrix of pixel-forming portions, and in a horizontally periodical pattern having a cycle of "up, down, up, down, up, down, down, up, down, up, down, up" or "down, up, down, up, down, up, up, down, up, down, up, down" as to which of the up row and down row is selected in the assignment of twelve pixel electrodes;

the delaying circuit delaying the feeding of the signal to the data signal lines feeding the pixel-forming portions including the simultaneously-selected pixel electrodes assigned to the up row of the two rows, by a single cycle of the horizontal scanning period.

10. The column electrode driving circuit according to claim 9, further comprising a holding circuit holding image data of an image to be displayed in the liquid crystal panel, sequentially, line by line, for a single cycle of the horizontal scanning period, and outputting an internal image signal carrying the line of the image data held within;

wherein the output circuit outputs the data signals based on the internal image signal so that a polarity of voltage applied to the pixel electrode is the same for the simultaneously-selected pixel electrodes and is altered for each horizontal scanning period;

the delaying circuit being placed between the holding circuit and the outputting circuit, and selectively delaying the internal image signal for the output of the data signal from the output circuit to the data signal lines related to the pixel-forming portions including the simultaneously-selected pixel electrodes assigned to the up row of the two rows, by a single cycle of the horizontal scanning period.

* * * * *